US011457318B2

(12) United States Patent
Wiss

(10) Patent No.: US 11,457,318 B2
(45) Date of Patent: Sep. 27, 2022

(54) HEARING DEVICE CONFIGURED FOR AUDIO CLASSIFICATION COMPRISING AN ACTIVE VENT, AND METHOD OF ITS OPERATION

(71) Applicant: SONOVA AG, Staefa (CH)

(72) Inventor: Daniel Wiss, Hinwil (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/200,465

(22) Filed: Mar. 12, 2021

(65) Prior Publication Data

US 2021/0306772 A1 Sep. 30, 2021

(30) Foreign Application Priority Data

Mar. 30, 2020 (EP) ..... 20166817

(51) Int. Cl.
*H04R 25/00* (2006.01)
*G10L 25/51* (2013.01)

(52) U.S. Cl.
CPC ..... *H04R 25/505* (2013.01); *G10L 25/51* (2013.01); *H04R 25/40* (2013.01); *H04R 25/558* (2013.01);
(Continued)

(58) Field of Classification Search
CPC .. H04R 25/505; H04R 1/1016; H04R 1/1041; H04R 1/2823; H04R 1/1083;
(Continued)

(56) References Cited

U.S. PATENT DOCUMENTS 6,549,635 B1 4/2003 Gebert
2005/0041824 A1 2/2005 Arndt et al.
(Continued)

FOREIGN PATENT DOCUMENTS

EP 2164277 3/2010
EP 3036915 10/2018
(Continued)

OTHER PUBLICATIONS

Extended European Search Report received in EP Application No. 20166817.5 dated Sep. 24, 2020.

*Primary Examiner* — Norman Yu
(74) *Attorney, Agent, or Firm* — ALG Intellectual Property, LLC

(57) ABSTRACT

A hearing device may include a housing configured to be at least partially inserted into an ear canal of a user and comprising a venting channel, wherein the venting channel is configured to provide for venting between an inner region of the ear canal and an ambient environment outside the ear canal through the venting channel; an acoustic valve comprising a valve member moveable relative to the venting channel between different positions; a sound detector configured to provide an audio signal representative of a detected sound; a processor configured to determine a characteristic from the audio signal and to classify the audio signal by assigning the audio signal to a class from a plurality of predetermined classes depending on the determined characteristic; and an output transducer configured to be acoustically coupled to the inner region of the ear canal.

17 Claims, 8 Drawing Sheets

(52) U.S. Cl.
CPC ..... *H04R 25/604* (2013.01); *H04R 25/652* (2013.01); *H04R 2225/41* (2013.01); *H04R 2225/61* (2013.01); *H04R 2460/11* (2013.01)

(58) Field of Classification Search
CPC .... H04R 1/2826; H04R 25/40; H04R 25/558; H04R 25/604; H04R 25/652; H04R 2225/41; H04R 2225/61; H04R 2460/11; G10L 25/51
USPC ..... 381/313, 328, 322, 325
See application file for complete search history.

(56) References Cited

U.S. PATENT DOCUMENTS

| | | | | |
|---|---|---|---|---|
| 2014/0169579 | A1* | 6/2014 | Azmi ..... | G10K 11/17827 381/71.6 |
| 2017/0208382 | A1 | 7/2017 | Grinker | |
| 2018/0295455 | A1 | 10/2018 | Eichfeld et al. | |

FOREIGN PATENT DOCUMENTS

| | | | |
|---|---|---|---|
| EP | 3471432 | | 4/2019 |
| EP | 3627848 | | 3/2020 |
| WO | 2019052715 | | 3/2019 |
| WO | WO-2019052714 | A1 * | 3/2019 |
| WO | 2020152323 | | 7/2020 |
| WO | 2020152324 | | 7/2020 |
| WO | 2020224914 | | 11/2020 |

* cited by examiner

HEARING DEVICE CONFIGURED FOR AUDIO CLASSIFICATION COMPRISING AN ACTIVE VENT, AND METHOD OF ITS OPERATION

RELATED APPLICATIONS

The present application claims priority to EP Patent Application No. EP20166817.5, filed Mar. 30, 2020, the contents of which are hereby incorporated by reference in their entirety.

BACKGROUND INFORMATION

Hearing devices are typically used to improve the hearing capability or communication capability of a user, for instance by compensating a hearing loss of a hearing-impaired user, in which case the hearing device is commonly referred to as a hearing instrument such as a hearing aid, or hearing prosthesis. The hearing device may pick up the surrounding sound with a microphone, process the microphone signal thereby taking into account the hearing preferences of the user of the hearing device, and provide the processed sound signal to an output transducer stimulating the user's hearing. The output transducer can be a miniature loudspeaker, commonly referred to as a receiver, for producing a sound in the user's ear canal. A hearing device may also be used to produce a sound in a user's ear canal based on an audio signal which may be communicated by a wire or wirelessly to the hearing device. Hearing devices are often employed in conjunction with communication devices, such as smartphones, for instance when listening to sound data processed by the communication device and/or during a phone conversation operated by the communication device. More recently, communication devices have been integrated with hearing devices such that the hearing devices at least partially comprise the functionality of those communication devices.

Hearing devices have been equipped with a classifier to classify an ambient sound. A sound detector such as a microphone can provide an audio signal representative of the ambient sound. The sound classifier can classify the audio signal allowing to identify different listening situations by determining a characteristic from the audio signal and assigning the audio signal to a relevant class from a plurality of predetermined classes depending on the characteristic. Usually, the sound classification does not directly modify a sound output of the hearing device. Instead, different sound processing programs are stored in a memory of the hearing device specifying different audio processing parameters for a processing of the audio signal, wherein the different classes are each associated with one of the different programs. After assigning the audio signal to a class, the associated sound processing program is executed. The audio processing parameters specified by the program can then provide a processing of the audio signal customized for the particular listening situation corresponding to the class identified by the classifier. The different listening situations may comprise, for instance, different classes of listening conditions and/or different classes of sounds. For example, the different classes may comprise speech and/or nonspeech and/or music and/or traffic noise and/or other ambient noise.

The classification may be based on a statistical evaluation of the audio signal, as disclosed in EP 3 036 915 B1. More recently, machine learning (ML) algorithms have been employed to classify the ambient sound. The classifier can be implemented by an artificial intelligence (AI) chip which may be configured to classify the audio signal by at least one deep neural network (DNN). The classifier may comprise a sound source separator configured to separate sound generated by different sound sources, for instance a conversation partner, passengers passing by the user, vehicles moving in the vicinity of the user such as cars, airborne traffic such as a helicopter, a sound scene in a restaurant, a sound scene including road traffic, a sound scene during public transport, a sound scene in a home environment, and/or the like. Examples of such a sound source separator are disclosed in international patent application Nos. PCT/EP 2020/051 734 and PCT/EP 2020/051 735, and in German patent application No. DE 10 2019 206 743.3.

Some hearing devices comprise a housing configured to be at least partially inserted into an ear canal. For instance, the housing may be implemented as an earpiece. When the housing of a hearing device is at least partially inserted into an ear canal, it may form an acoustical seal with an ear canal wall such that it blocks the ear canal so that an inner region of the ear canal between the housing and the eardrum is acoustically insulated from the ambient environment outside the ear canal to some extent. Isolation provided by hearing devices may be desirable because it can prevent interference of ambient sound with the acoustic output of the hearing device. However, because ambient sound may be blocked from the eardrum, it may prevent a user of the hearing device from directly hearing external sounds such as someone trying to communicate with the user. In addition, sealing the ear canal can create an occlusion effect in the ear canal, whereby the hearing device wearer may perceive "hollow" or "booming" echo-like sounds, which can have a profoundly disturbing impact on the hearing experience.

An active vent may be included in the hearing device comprising a venting channel extending through the housing's inner volume by which an atmospheric connection between the inner region of the ear canal and the ambient environment outside the ear canal can be provided. The occlusion effect can thus be mitigated or circumvented by a pressure compensation between the inner region of the ear canal and the ambient environment outside the ear canal. The active vent further comprises an acoustic valve allowing to adjust the venting channel such that an effective size of the venting channel can be enlarged or reduced, for instance such that the venting channel is either in a more opened or closed state. The acoustic valve comprises a valve member moveable relative to the venting channel between different positions to adjust the effective size of the venting channel. Such an active vent is described, for instance, in U.S. patent application publication No. US 2017/0208382 A1, in international patent application publication No. WO 2019/052715 A1, and in European patent application Nos. EP 2 164 277 A2 and EP 3 471 432 A1. The adjustment of the effective size may thus either allow sound to be increasingly vented from the ear canal through the housing to the ambient environment, or to restrict or prevent such transmission of sound. The movement of the valve member between the different positions can be actuated by an actuator which can be operatively coupled to a processor of the hearing device providing a control signal for the actuation.

Different effective sizes of the venting channel can be appropriate for different sound classes assigned to the audio signal by the hearing device. For instance, a more enlarged size of the venting channel may be often preferred by the user in a sound scene involving a rather low noise level in the ambient environment such that direct sound can be passed from the environment through the venting channel to the eardrum. A more enlarged venting size may also be favorable in many cases involving a speech of the user to minimize bone-conducted reverberations from an own voice activity of the user. In contrast, the user may often give priority to a more reduced size of the venting channel in situations involving a high noise level in the ambient environment in order to block the noise from directly entering the inner region of the ear canal. Reduced venting may also be favored sometimes during streaming of an audio signal, for instance from a media source and/or from a remote microphone, when the user is not interested in audio content representative of sound in the ambient environment. United States patent publication No. U.S. Pat. No. 6,549,635 B1 proposes to reduce the effective size of the venting channel during a hearing aid function such as a directional effect or background noise reduction.

The processor of the hearing device may control the actuator to automatically actuate the movement of the valve member depending on the class assigned to the audio signal by the hearing device. The automated vent control can be convenient in that it sets an optimum size of the venting channel during many hearing situations that may occur for a specific class assigned to the audio signal by the sound classifier. Moreover, the user can be liberated from a frequent manual switching of the active vent back and forth between the different positions of the acoustic valve via a user interface. In some hearing situations, however, the user may prefer a different size of the venting channel than the automatically adjusted size based on the class assigned to the audio signal. For instance, an automatic adjustment of the venting channel to a more reduced size for a sound class associated with a high noise level may be desired in some situations in which the ambient noise is perceived as disturbing by the user, and may be undesired in other situations in which the user intents to listen to the sound in his environment, for instance during a concert. The automatic adjustment of the venting channel to a more enlarged size for a sound class associated with an own voice activity may be adequate in some situations in which the user speaks in an environment of low ambient noise, and may be inadequate in other situations in which the user's speech is superimposed by a high ambient noise level.

In those situations, in which the user's listening preferences deviate from the acoustic configuration provided by the automatic vent adjustment, the user may manually control the actuator of the active vent to move the valve member to a position more closely corresponding to his listening preferences. However, the sound processing program selected by the processor based on the sound class assigned to the audio signal may then not be optimally matched to the acoustic configuration which has been produced by the adjustment of the effective size of the venting channel selected by the user. For instance, the audio processing parameters applied by the processor for a sound class associated with a low noise level during a more enlarged size of the venting channel selected by the user may result in an amplification of the audio signal within a certain frequency range which may be perceived as too severe and/or unnatural by the user when the venting channel is reduced. Enlarging the venting channel can lead to a similar effect when the audio processing parameters are optimized for the more reduced size. This may result in a rather unpleasant listening experience for the user.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION

Figure 1:
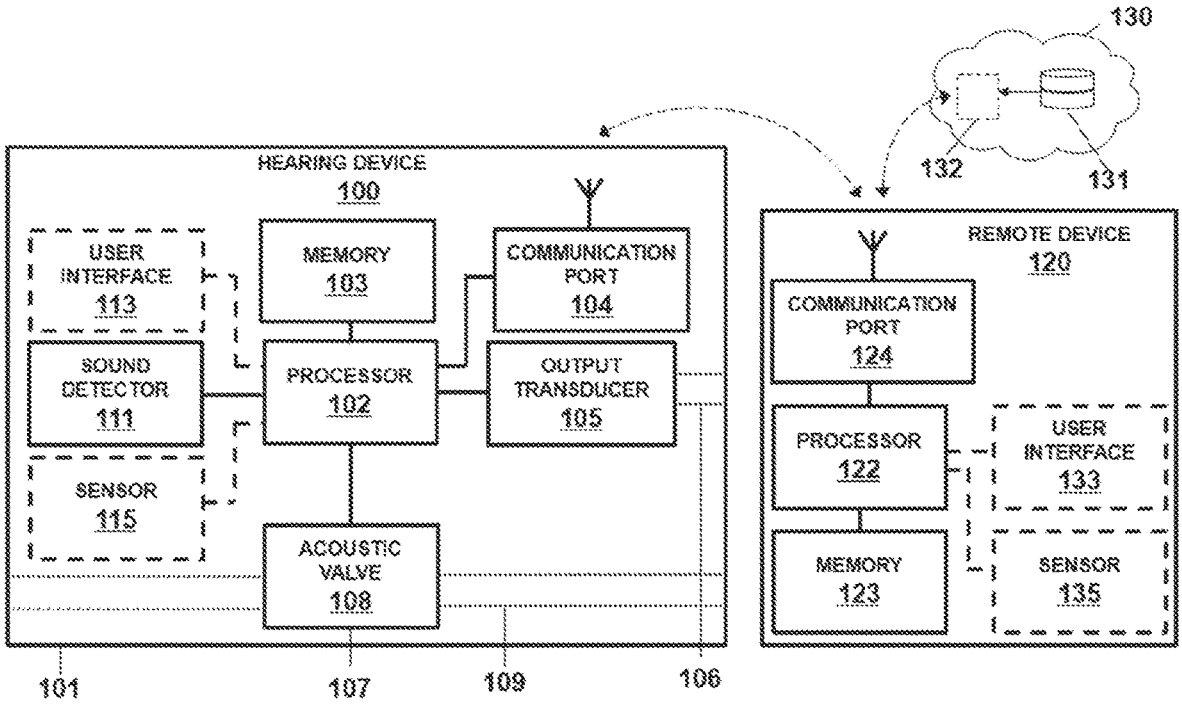
FIGS. 1-2 schematically illustrate exemplary hearing devices including an active vent.

It is a feature of the present disclosure to avoid at least one of the above mentioned disadvantages and to provide a hearing device and/or a hearing system and/or a method of operating the hearing device with an improved audio processing capability in which modifications of an acoustic configuration of the hearing device caused by an adjusted size of the venting channel can be compensated for a given sound class attributed to the audio signal. It is another feature to provide an improved sound quality and/or speech intelligibility in varying sound scenes, in particular when some sound scenes can be attributed to the same class and/or some sound scenes can be attributed to mutually different classes. It is a further feature to allow a facilitated operation of the hearing device by the user when encountering varying sound scenes. It is yet another feature to adapt a hearing device for an improved audio processing capability when the valve member is at different positions, in particular to implement an audio processing at the different valve positions in a customizable way and/or with a reduced memory consumption for a storing of required audio processing parameters and/or at low modification requirements of the hearing device.

Accordingly, the present disclosure proposes a hearing device comprising a housing configured to be at least partially inserted into an ear canal of a user and comprising a venting channel, wherein the venting channel is configured to provide for venting between an inner region of the ear canal and an ambient environment outside the ear canal through the vent; an acoustic valve comprising a valve member moveable relative to the venting channel between different positions, wherein an effective size of the venting channel is adjustable by a movement of the valve member between the different positions, and an actuator configured to actuate the movement of the valve member; a sound detector configured to provide an audio signal representative of a detected sound; a processor configured to determine a characteristic from the audio signal and to classify the audio signal by assigning the audio signal to a class from a plurality of predetermined classes depending on the determined characteristic, at least two of said predetermined classes associated with different audio processing parameters applied by the processor for a processing of the audio signal, the processor is further configured to apply different audio processing parameters when the valve member is at the different positions, wherein the class assigned to the audio signal is equal for at least one of said predetermined classes at the different positions of the valve member; and an output transducer configured to be acoustically coupled to the inner region of the ear canal and to generate a sound output according to the audio signal processed by the processor.

Modifications of the acoustic configuration of the hearing device caused by an adjustment of the effective size of the venting channel may thus be compensated by the different audio processing parameters even if the class assigned to the audio signal is equal at the different positions of the valve member. The different audio processing parameters at the different positions of the valve member can account for an improved sound quality and/or speech intelligibility in varying sound scenes which may be attributed to an equal class and in which different positions of the valve member may be employed. Providing the different audio processing parameters at the different positions of the valve member may also facilitate an operation of the hearing device by the user, for instance by avoiding tedious sound processing adjustments which may be required when the user autonomously changes the position of the valve member and is not satisfied with the sound output according to the audio processing parameters optimized for a different position of the valve member.

The disclosure further proposes a hearing system comprising the hearing device and a remote device and/or a computer readable medium.

The present disclosure also proposes a method of operating a hearing device, the hearing device comprising a housing configured to be at least partially inserted into an ear canal of a user and comprising a venting channel, wherein the venting channel is configured to provide for venting between an inner region of the ear canal and an ambient environment outside the ear canal through the venting channel; an acoustic valve comprising a valve member moveable relative to the venting channel between different positions, wherein an effective size of the venting channel is adjustable by a movement of the valve member between the different positions, and an actuator configured to actuate the movement of the valve member; a sound detector configured to provide an audio signal representative of a detected sound; and an output transducer configured to be acoustically coupled to the inner region of the ear canal and to generate a sound output according to a processed audio signal, wherein the method comprises determining a characteristic from the audio signal; classifying the audio signal by assigning the audio signal to a class from a plurality of predetermined classes depending on the determined characteristic, at least two of said predetermined classes associated with different audio processing parameters applied for the processing of the audio signal; and applying different audio processing parameters when the valve member is at the different positions, wherein the class assigned to the audio signal is equal for at least one of said predetermined classes when the valve member is at the different positions.

The present disclosure proposes a non-transitory computer-readable medium storing instructions that, when executed by a processor, cause a hearing device and/or a hearing system to perform operations of the method.

Subsequently, additional features of some implementations of the hearing device and/or hearing system and/or method of operating a hearing device are described. Each of those features can be provided solely or in combination with at least another feature. The features can be correspondingly provided in some implementations of the hearing device and/or the hearing system and/or the method of operating a hearing device and/or the computer-readable medium.

The different processing parameters may be applied at the different positions of the valve member when an equal class and/or a different class of the predetermined classes is assigned to the audio signal, wherein at least one of the predetermined classes is equally assigned to the audio signal at different positions of the valve member. The same class may thus be assigned to the audio signal for at least one of said predetermined classes at the different positions of the valve member. In some instances, different processing parameters are applied for at least two of said predetermined classes when the valve member is at different positions and the equal class is assigned to the audio signal. The processor may then be configured to apply the different audio processing parameters at the different positions of the valve member for each of at least two of said predetermined classes equally assigned to the audio signal when the valve member is at the different positions.

The different processing parameters applied when an equal class is assigned to the audio signal at the different positions of the valve member may be selected to compensate a change of the acoustic configuration caused by a change of the effective size of the venting channel. The change of the acoustic configuration may comprise a different amount of direct sound passing from the ambient environment through the venting channel to the inner region of the ear canal. The venting channel may be configured to provide for venting of sound waves between the inner region of the ear canal and the ambient environment outside the ear canal. The sound detector may be configured to provide an audio signal representative of sound detected in an ambient environment of the user.

In some implementations, the predetermined classes comprise a first class for which the associated audio processing parameters comprise audio processing parameters providing for a directivity of the processed audio signal, in particular an acoustic beamforming, and a second class for which the associated audio processing parameters comprise audio processing parameters providing for an omnidirectional audio content in the processed audio signal. The different audio processing parameters when the valve member is at the different positions and the class assigned to the audio signal is equal may comprise first audio processing parameters providing for a directivity of the processed audio signal, and second audio processing parameters providing for an omnidirectional audio content in the processed audio signal. The processor may be configured to apply the different audio processing parameters when the first class is equally assigned to the audio signal at the different positions of the valve member, wherein the different audio processing parameters comprise audio processing parameters providing for an increased directivity of the audio content in the processed audio signal and audio processing parameters providing for a decreased directivity of the audio content in the processed audio signal. Thus, when the first class is assigned to the audio signal, audio processing parameters providing for the increased directivity may be provided at a first position of the valve member, and audio processing parameters providing for the decreased directivity may be provided at a second position of the valve member. The increased directivity may be defined by an enlarged width of an acoustic beam formed by applying the audio processing parameters, and the decreased directivity may be defined by a reduced width of an acoustic beam formed by applying the audio processing parameters. The first position of the valve member may correspond to a position associated by the processor with the first class when the first class is assigned to the audio signal. A positioning of the valve member at the first position associated with the first class assigned to the audio signal may be overruled by instructions to move the valve member to the second position. The instructions may comprise instructions received from a user interface and/or instructions derived from sensor data.

In some implementations, the decreased directivity can provide for an omnidirectional audio content in the processed audio signal. Thus, when the first class is assigned to the audio signal, audio processing parameters providing for the increased directivity may be provided at a first position of the valve member, and audio processing parameters providing for the omnidirectional audio content may be provided at a second position of the valve member.

In some implementations, the predetermined classes comprise a first class for which the associated audio processing parameters comprise audio processing parameters providing for an increased noise suppression in the processed audio signal, and a second class for which the associated audio processing parameters comprise audio processing parameters providing for a decreased noise suppression in the processed audio signal. The processor may be configured to apply the different audio processing parameters when the first class is equally assigned to the audio signal at the different positions of the valve member, wherein the different audio processing parameters at the different positions comprise the audio processing parameters providing for the increased noise suppression in the processed audio signal and audio processing parameters providing for a noise suppression in the processed audio signal which is lower than said increased noise suppression and larger than said decreased noise suppression. Thus, when the first class is assigned to the audio signal, audio processing parameters providing for the increased noise suppression may be provided at a first position of the valve member, and audio processing parameters providing for the noise suppression lower than said increased noise suppression and larger than said decreased noise suppression may be provided at a second position of the valve member. The first position of the valve member may correspond to a position associated by the processor with the first class when the first class is assigned to the audio signal. A positioning of the valve member at the first position associated with the first class assigned to the audio signal may be overruled by instructions to move the valve member to the second position. The instructions may be received from a user interface and/or derived from sensor data.

In some implementations, the predetermined classes comprise a first class for which the associated audio processing parameters comprise audio processing parameters providing for a decreased amplification level in the processed audio signal, and a second class for which the associated audio processing parameters comprise audio processing parameters providing for an increased amplification level in the processed audio signal. The processor may be configured to apply the different audio processing parameters when the second class is equally assigned to the audio signal at the different positions of the valve member, wherein the different audio processing parameters at the different positions comprise the audio processing parameters providing for the increased amplification level in the processed audio signal and audio processing parameters providing for an amplification level in the processed audio signal which is lower than said increased amplification level and larger than said decreased amplification level. Thus, when the second class is assigned to the audio signal, audio processing parameters providing for the increased amplification level may be provided at a first position of the valve member, and audio processing parameters providing for the amplification level lower than said increased amplification level and larger than said decreased amplification level may be provided at a second position of the valve member. The first position of the valve member may correspond to a position associated by the processor with the second class when the second class is assigned to the audio signal. A positioning of the valve member at the first position associated with the second class assigned to the audio signal may be overruled by instructions to move the valve member to the second position. The instructions may be received from a user interface and/or derived from sensor data.

The hearing device may comprise a memory storing the different audio processing parameters applied by the processor when the valve member is at the different positions and the class assigned to the audio signal is equal at the different positions of the valve member. For instance, the memory may store a plurality of sound processing programs, at least one of the sound processing programs specifying audio processing parameters different from audio processing parameters specified by another sound processing program.

It may be that the characteristic determined from the audio signal comprises a characteristic of an ambient noise. For instance, the characteristic may comprise a noise level indicative of a level of the ambient noise. It may also be that the characteristic determined from the audio signal comprises a characteristic of an own voice activity of the user.

In some implementations, the processor is configured to associate each of at least two of said predetermined classes with one of said different positions of the valve member and to control the actuator to move the valve member to the position associated with the class assigned to the audio signal. The predetermined classes may comprise a first class assigned to the audio signal when the characteristic of the ambient noise, for instance a noise level, is determined to be above a threshold and a second class when the characteristic of the ambient noise, for instance the noise level, is determined to be below the threshold, wherein the first class is associated with a first position of the valve member at which the effective size of the venting channel is reduced and the second class is associated with a second position of the valve member at which the effective size of the venting channel is enlarged.

In some implementations, the processor is configured to receive instructions from a user interface to control the actuator to move the valve member between the different positions from a current position to a target position. The user interface may be configured to provide the instructions depending on a user interacting with the user interface. The processor may be configured to control the actuator to move the valve member from the position associated with the class assigned to the audio signal to the target position according to the instructions from the user interface. The instructions from the user interface may overrule the controlling of the actuator to move the valve member to the position associated with the class assigned to the audio signal.

In some implementations, the processor is configured to receive sensor data from a sensor and to derive instructions from the sensor data to control the actuator to move the valve member between the different positions from a current position to a target position depending on the sensor data. The sensor may be configured to detect a property on the user, in particular a physiological property of the user, and/or a property in the ambient environment of the user. In some instances, the sensor comprises a movement sensor and/or a biometric sensor. The processor may be configured to control the actuator to move the valve member from the position associated with the class assigned to the audio signal to the target position according to the instructions derived from the sensor data. The instructions derived from the sensor data may overrule the controlling of the actuator to move the valve member to the position associated with the class assigned to the audio signal.

The different positions of the valve member may comprise a first position and a second position, and the different audio processing parameters may comprise first audio processing parameters applied by the processor at the first position and second audio processing parameters applied by the processor at the second position, wherein the class assigned to the audio signal is equal when the valve member is at the first position and at the second position for at least one of the predetermined classes.

In some implementations, the processor is configured to determine at least one of the different audio processing parameters applied at the different positions of the valve member when the class assigned to the audio signal is equal by modifying the audio processing parameters associated with the class assigned to the audio signal based on predetermined modification rules. The predetermined modification rules may comprise combining predetermined audio processing parameters with the audio processing parameters associated with the class assigned to the audio signal. The combining of the predetermined audio processing parameters may comprise adding the predetermined audio processing parameters to the audio processing parameters associated with the class assigned to the audio signal or subtracting the predetermined audio processing parameters from the audio processing parameters associated with the class assigned to the audio signal. The predetermined audio processing parameters may be modification parameters.

The predetermined audio processing parameters may comprise parameters combined with the audio processing parameters associated with the class assigned to the audio signal when the valve member is moved to a position at which an effective size of the venting channel is reduced. The predetermined audio processing parameters may comprise parameters combined with the audio processing parameters associated with the class assigned to the audio signal when the valve member is moved to a position at which an effective size of the venting channel is enlarged. The predetermined audio processing parameters may be stored in a memory of a remote device and/or in a memory of the hearing device. The predetermined modification rules, in particular the predetermined audio processing parameters that are combined with the audio processing parameters associated with the class assigned to the audio signal, may be received by the processor of the hearing device from a remote device. The predetermined modification rules may be received by the processor of the hearing device from the remote device when the instructions to control the actuator to move the valve member between the different positions are received from the user interface, in particular from a user interface of the remote device.

The hearing system may comprise a computer-readable medium storing instructions that, when executed by a processor included in the remote device, cause the processor included in the remote device to provide the predetermined modification rules to the hearing device, in particular to the processor of the hearing device. In particular, the instructions may cause the processor included in the remote device to provide the predetermined audio processing parameters to the hearing device, which predetermined audio processing parameters are combined, by the processor of the hearing device, with the audio processing parameters associated with the class assigned to the audio signal. The hearing system may also comprise a remote device comprising a processor configured to provide the predetermined modification rules to the processor of the hearing device.

Referring to FIG. 1, a hearing device 100 according to some embodiments of the present disclosure is illustrated. As shown, hearing device 100 includes a processor 102 communicatively coupled to a sound detector 111, a memory 103, a communication port 104, an output transducer 105, and an acoustic valve 108 of an active vent 107. Output transducer 105 may be implemented by any suitable audio output device, for instance a loudspeaker or a receiver of a hearing aid. FIG. 1 further illustrates an exemplary remote device 120 configured to be operated remote from hearing device 100. For instance, the remote device may be a handheld device such as a smartphone, or a stationary processing device such as a personal computer (PC). Remote device 120 includes a processor 122 communicatively coupled to a memory 123 and a communication port 124 configured to communicate with communication port 104 of hearing device 100. A hearing system may comprise hearing device 100 and remote device 120.

Hearing device 100 comprises a housing 101 configured to be at least partially inserted into an ear canal. After insertion, at least a portion of housing 101 can be in contact with an ear canal wall of the ear canal. Housing 101 can thus form an acoustical seal with the ear canal wall at the housing portion contacting the ear canal wall. The acoustical seal can, at least to some extent, provide acoustical isolation of an inner region of the ear canal from an ambient environment outside the ear canal. Active vent 107 comprises acoustic valve 108 and a venting channel 109. Venting channel 109 extends through an inner volume surrounded by housing 102. Venting channel 109 can acoustically interconnect the inner region of the ear canal and the ambient environment outside the ear canal after insertion of housing 102 into the ear canal. Venting channel 109 is thus configured to provide for venting between the inner region of the ear canal and the ambient environment. Acoustic valve 108 is configured to modify an effective size of venting channel 109. Modifying the effective size of venting channel 109 allows to adjust an amount of the venting between the inner region of the ear canal and the ambient environment. Processor 102 is configured to provide a control signal to control the adjustment of the effective size of venting channel 109 by acoustic valve 108.

Housing 102 further includes a sound conduit 106. Sound conduit 106 is acoustically coupled to output transducer 105. Sound conduit 106 is configured to provide for transmission of sound waves from output transducer 105 to the inner region of the ear canal. Output transducer 105 can be acoustically coupled to the inner region of the ear canal via sound conduit 106. A sound generated by output transducer 105 based on an audio signal processed by processor 102 can thus be output into the inner region of the ear canal via sound conduit 106. In some implementations, as illustrated in FIG. 1, venting channel 109 and sound conduit 106 can be provided separate from one another. In some other implementations, as further exemplified below, venting channel 109 and sound conduit 106 can comprise a common pathway through which sound waves can pass through. Output transducer 105 may be implemented by any suitable audio output device, for instance a loudspeaker or a receiver.

Sound detector 111 may be implemented by any suitable sound detection device, such as a microphone, in particular a microphone array, and/or a voice activity detector (VAD), and is configured to detect a sound presented to a user of hearing device 100 and to provide an audio signal representative of the detected sound to processor 102. The sound can comprise ambient sound such as audio content (e.g., music, speech, noise, etc.) generated by one or more sound sources in an ambient environment of the user. The sound can also include audio content generated by a voice of the user during an own voice activity, such as a speech by the user. The own voice activity may be detected by a VAD. The VAD may be configured to detect sound from bone conducted vibrations transmitted from the user's vocal chords to the user's ear canal and/or to estimate an own voice sound portion from sound detected by an ambient microphone and/or an ear canal microphone.

Memory 103, 123 may be implemented by any suitable type of storage medium and is configured to maintain, e.g. store, data controlled by processor 102, 122, in particular data generated, accessed, modified and/or otherwise used by processor 102, 122. For example, memory 103 of hearing device 100 may maintain data representative of a plurality of sound processing programs including mutually different audio processing parameters which can be applied by processor 102 for a processing of the audio signal. The audio processing parameters can specify how processor 102 processes audio content (e.g., audio content included in the audio signal detected by sound detector 111) to present the audio content to a user. To illustrate, memory 103 may maintain data representative of different audio processing parameters that specify different audio amplification schemes (e.g., amplification levels, frequency dependent gain curves, a directivity of an acoustic beamforming, etc.) used by processor 102 to provide an amplified version of the audio content to the user.

As another example, memory 123 of remote device 120 may also maintain data representative of different audio processing parameters which can be applied by processor 102 of hearing device 100 for a processing of the audio signal. The audio processing parameters stored in memory 123 of remote device 120 may be transmitted to processor 102 of hearing device 100 via communication ports 124, 104. In some examples, processor 102 of hearing device 100 may modify audio processing parameters accessed from memory 103 by combining the audio processing parameters accessed from memory 103 with audio processing parameters received from remote device 120. The audio processing parameters received from remote device 120 can thus correspond to predetermined modification rules for the audio processing parameters accessed from memory 103. An amplified version of the audio content presented to the user may be specified by the audio processing parameters of a sound processing program stored in memory 103 of hearing device 100 combined with audio processing parameters stored in memory 123 of remote device 120 according to the predetermined modification rules. To illustrate, the audio processing parameters stored in memory 123 of remote device 120 may be audio amplification schemes that are added or subtracted by processor 102 to the audio processing parameters of a sound processing program stored in memory 103. The modified audio processing parameters of the sound processing program accessed from memory 103 may then be applied by processor 102 for the processing of the audio signal.

Communication port 104, 124 may be implemented by any data transducer configured to exchange data between hearing device 100 and remote device 120 via a communication link. Communication port 104, 124 may be configured for wireless data communication. For instance, data may be communicated in accordance with a Bluetooth™ protocol and/or by any other type of radio frequency communication such as, for example, data communication via an internet connection and/or a mobile phone connection. The transmitted data may comprise data maintained in memory 123 of remote device. For instance, the transmitted data may comprise audio processing parameters stored in memory 123 of remote device. The transmitted data may comprise instructions that can be executed by processor 102 of hearing device 100. For instance, the transmitted data may comprise an adjustment indicator comprising instructions for processor 102 to control acoustic valve 108 to adjust an effective size of venting channel 109. The transmitted data may also comprise instructions for processor 102 to select a sound processing program stored in memory 103 to apply corresponding audio processing parameters for a processing of the audio signal and/or to modify the audio processing parameters of a selected sound processing program based on the predetermined modification rules specified by the transmitted data.

Remote device 120 may be configured to communicate with a computer implemented medium 131. A hearing system may comprise hearing device 100 and computer implemented medium 131 and/or remote device 120. Computer implemented medium 131 may comprise an external data storage, such as a cloud 130. Data 132 from computer implemented medium 131 may be received by processor 122 via communication port 124. Data 132 may comprise instructions executable by processor 122 of remote device 120. Data 132 may also comprise audio processing parameters for a processing of the audio signal by processor 102 of hearing device 100. Data 132 may also comprise predetermined modification rules for audio processing parameters applied by processor 102 for a processing of the audio signal, for instance according to a sound processing program stored in memory 103. The audio processing parameters and/or predetermined modification rules received from computer implemented medium 131 may be stored in memory 123 of remote device 120 and/or transmitted to processor 102 of hearing device 100 via communication ports 104, 124. It may also be that hearing device 100 is configured to communicate with computer implemented medium 131 via communication port 104 such that data 132 can be received by processor 102 and/or instructions transmitted by data 132 can be executed by processor 102.

Hearing device 100 and/or remote device 120 may further comprise a user interface 113, 133. Processor 102, 122 may be communicatively coupled to user interface 113, 133. User interface 113, 133 may be implemented by any suitable sensor allowing to determine an interaction by a user, and to provide corresponding user input data to processor 102, 122. For instance, user interface 113, 133 may comprise a push button and/or a touch sensor and/or a tapping detector provided at hearing device 100 and/or remote device 120. The user input data provided by user interface 133 of remote device 120 may be transmitted to processor 102 of hearing device 100 via communication ports 104, 124. The user input data provided by user interface 113, 133 may comprise instructions executable by processor 102 of hearing device 100. For instance, the user input data may comprise an adjustment indicator comprising instructions for processor 102 to control acoustic valve 108 to adjust an effective size of venting channel 109. The user input data may also comprise instructions for processor 102 to select a sound processing program stored in memory 103 to apply corresponding audio processing parameters for a processing of the audio signal and/or to modify the audio processing parameters of a selected sound processing program based on predetermined modification rules.

Hearing device 100 and/or remote device 120 may further comprise a sensor 115, 135. Processor 102, 122 may be communicatively coupled to sensor 115, 135. Sensor 115, 135 may be implemented by any suitable sensor configured to provide sensor data indicative of a physical property detected on the user wearing the hearing device and/or in an ambient environment of the user, or by a combination of those sensors. For instance, sensor data detected in the environment can be representative of a temperature of the environment, humidity of the environment, an altitude, a location, a movement of the user in the environment, and/or the like. Sensor data detected on the user can be representative for a body temperature, heartrate, blood values of the user, an electrical activity of the user's body, and/or the like. The sensor data provided by sensor 115, 135 may be evaluated by processor 102, 122. Instructions executable by processor 102 of hearing device 100 may be provided based on the sensor data. The instructions may comprise an adjustment indicator comprising instructions for processor 102 to control acoustic valve 108 to adjust an effective size of venting channel 109. The instructions may also cause processor 102 to select a sound processing program stored in memory 103 to apply corresponding audio processing parameters for a processing of the audio signal and/or to modify the audio processing parameters based on predetermined modification rules.

In some implementations, sensor 115, 135 comprises a movement detector configured to provide movement data indicative of a movement of hearing device 100 and/or remote device 120. The movement detector may comprise at least one inertial sensor. The inertial sensor can include, for instance, an accelerometer configured to provide the movement data representative of an acceleration and/or displacement and/or rotation, and/or a gyroscope configured to provide the movement data representative of a rotation. In some implementations, sensor 115, 135 comprises a biometric sensor configured to measure a biological characteristic of the user's body and to provide biometric data indicative of the biological characteristic. For instance, the biometric sensor may comprise a photoplethysmography (PPG) sensor and/or an electrocardiography (ECG) sensor and/or an electroencephalography (EEG) sensor and/or an electrooculography (EOG) sensor and/or a temperature sensor. Sensor 135 of remote device 120 may also comprise a sound detector, which may be implemented corresponding to sound detector 111 of hearing device 100.

Processor 102 may be configured to determine a characteristic from the audio signal provided by sound detector 111, to classify the audio signal by assigning the audio signal to a class from a plurality of predetermined classes depending on the determined characteristic, wherein at least two of the predetermined classes are associated with mutually different audio processing parameters applied by processor 102 for a processing of the audio signal, and to apply different audio processing parameters at different effective sizes of venting channel 109 adjusted by acoustic valve 108, wherein the class assigned to the audio signal is equal for at least one of said predetermined classes at the different effective sizes of venting channel 109. In some instances, processor 102 is configured to control acoustic valve 108 to adjust the effective size of venting channel 109 depending on the class assigned to the audio signal. In some instances, processor 102 is configured to control acoustic valve 108 to adjust the effective size of venting channel 109 depending on an adjustment indicator which may be provided by user interface 113, 133 and/or based on the sensor data provided by sensor 115, 135. In some instances, processor 102 is configured to overrule the adjustment of the effective size of venting channel 109 depending on the class assigned to the audio signal with the adjustment of the effective size of venting channel 109 according to the adjustment indicator. Processor 102 may then be configured to apply the different audio processing parameters at the different effective sizes of venting channel 109 when the class assigned to the audio signal is equal at the different effective sizes. These and other operations that may be performed by processor 102 are described in more detail herein. In the description that follows, any references to operations performed by hearing device 100 may be understood to be performed by processor 102 of hearing device 100.

Hearing device 100 may be implemented by any type of hearing device configured to enable or enhance hearing of a user wearing hearing device 100. For example, hearing device 100 may be implemented by a hearing aid configured to provide an amplified version of audio content to a user, an earphone, or any other suitable hearing prosthesis. More particularly, different types of hearing devices can be distinguished by the components included in an earpiece enclosed by housing 101. Some hearing devices, such as behind-the-ear (BTE) hearing aids and receiver-in-the-canal (RIC) hearing aids, typically comprise housing 101 and an additional housing configured to be worn at a wearing position outside the ear canal, in particular behind an ear of the user. Some other hearing devices, as for instance earbuds, earphones, in-the-ear (ITE) hearing aids, invisible-in-the-canal (IIC) hearing aids, and completely-in-the-canal (CIC) hearing aids, commonly comprise housing 101 without an additional housing to be worn at the different ear position. For instance, those hearing devices can be provided as two earpieces each comprising such a housing 101 for wearing in a respective ear canal. Depending on a particular implementation of hearing device 100, processor 102 and/or memory 103 and/or sound detector 111 and/or communication port 104 and/or user interface 113 and/or sensor 115 and/or output transducer 105 may be accommodated in earpiece housing 101 or in the additional housing. Housing 101 typically accommodates at least sound conduit 106 for directing sound into the ear canal, and active vent 107.

Figure 2:
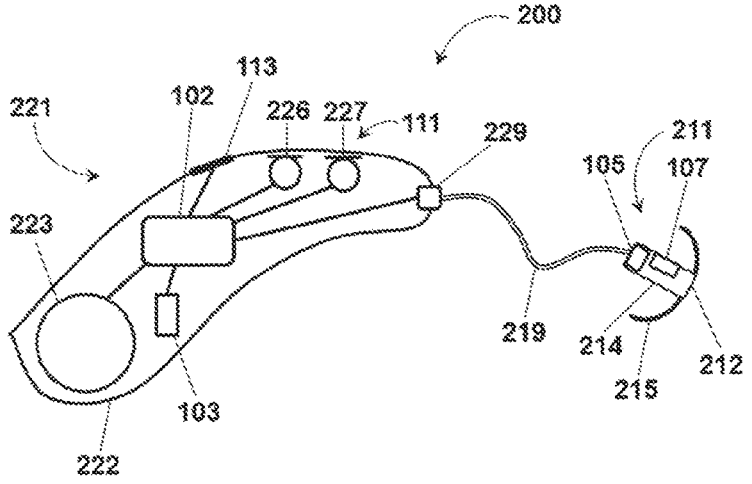

FIG. 2 illustrates exemplary implementations of a hearing device as a RIC hearing aid 200, in accordance with some embodiments of the present disclosure. RIC hearing aid 200 comprises a BTE part 221 configured to be worn at an ear at a wearing position behind the ear, and an ITE part 211 configured to be worn at the ear at a wearing position at least partially inside an ear canal of the ear. ITE part 211 is an earpiece comprising a housing 212 at least partially insertable in the ear canal. Housing 212 comprises an enclosure 214 accommodating output transducer 105 and active vent 107. Housing 212 further comprises a flexible member 215 adapted to contact an ear canal wall when housing 212 is at least partially inserted into the ear canal. In this way, an acoustical seal with the ear canal wall can be provided at the housing portion contacting the ear canal wall.

BTE part 221 comprises an additional housing 222 for wearing behind the ear. Additional housing 222 accommodates processor 102 communicatively coupled to memory 103, sound detector 111, and user interface 113 included in BTE part 221. BTE part 121 and ITE part 111 are interconnected by a cable 219. Processor 102 is communicatively coupled to output transducer 105 and active vent 107 via cable 219 and a cable connector 229 provided at additional housing 222. Processor 102 is thus configured to access an audio signal generated by sound detector 111, to process the audio signal, and to provide the processed audio signal to output transducer 105. Processor 102 is further configured to provide a control signal to active vent 107. In the illustrated example, sound detector 111 comprises a plurality of spaced apart microphones 226, 227. Sound detected by sound detector 111 in an ambient environment of the user can thus be spatially resolved. BTE part 221 further includes a battery 223 as a power source for the above described components including output transducer 105 and active vent 107.

Figure 3A:
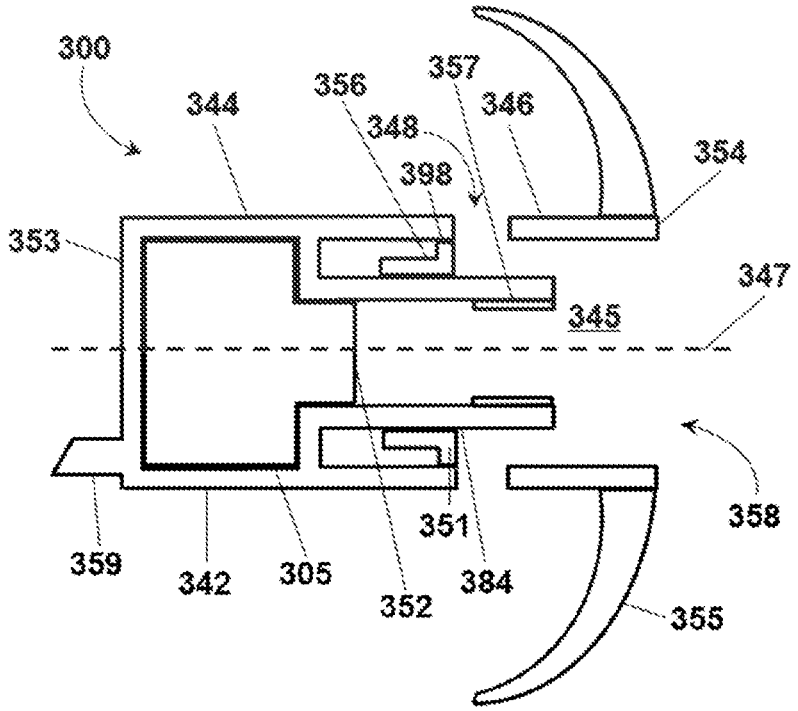
FIGS. 3A, B schematically illustrate an exemplary earpiece of a hearing device including an active vent in a longitudinal sectional view, wherein an acoustic valve of the active vent is in different valve positions.
Figure 3B:
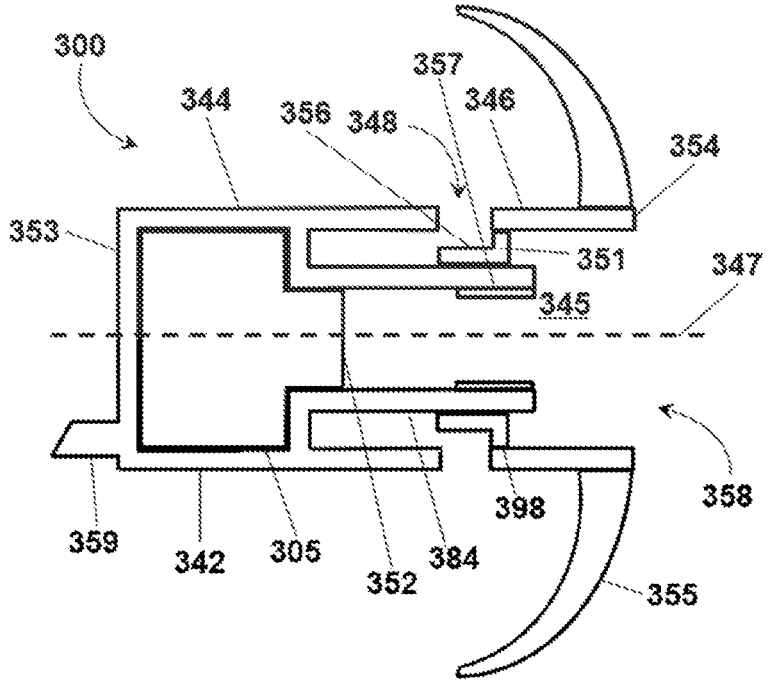

FIGS. 3A and 3B illustrate an earpiece 300 of a hearing device in accordance with some embodiments of the present disclosure. For example, earpiece 211 of hearing device 200 depicted in FIG. 2 may be implemented by earpiece 300. Earpiece 300 comprises a housing 342 configured to be at least partially inserted into an ear canal. Housing 342 comprises an outer wall 344 delimiting an inner space 345 from an exterior of housing 342. Outer wall 344 comprises a side wall 346 extending in a direction of the ear canal when housing 342 is at least partially inserted into the ear canal. Side wall 346 has a circumference surrounding a longitudinal axis 347 of housing 342. Longitudinal axis 347 extends in a direction in which housing 342 is insertable into the ear canal. Housing 342 has an opening 348. Opening 348 is provided as a through-hole in side wall 346. Opening 348 connects inner space 345 with the exterior of housing 342. Inner space 345 can thus be acoustically coupled with the exterior of housing 342 through opening 348. Opening 348 is a first opening of housing 342. Outer wall 344 further comprises a front wall 354 at a front end of housing 342. Front wall 354 faces the tympanic membrane at the end of the ear canal when housing 342 is at least partially inserted into the ear canal. Front wall 354 has an opening 358. Opening 358 is a second opening of housing 342. Opening 358 connects inner space 345 with the exterior of housing 342. The first opening 348 in side wall 346 and the second opening 358 in front wall 354 are acoustically coupled through inner space 345. Inner space 345 thus provides a venting channel between first opening 348 and second opening 358.

Housing 342 further comprises a sealing member 355. Sealing member 355 is configured to contact the ear canal wall when housing 342 is at least partially inserted into the ear canal. Sealing member 355 can thus form an acoustical seal with the ear canal wall such that an inner region of the ear canal between housing 342 and the tympanic membrane is acoustically isolated from the ambient environment outside the ear canal, at least to a certain degree. For instance, sealing member 355 can be provided as an elastic member configured to conform to an individual ear canal shape. Sealing member 355 can also be provided as a contoured member having an outer shape customized to an individual ear canal shape. Sealing member 355 is disposed between first opening 348 and second opening 358 such that the venting channel extending through inner space 345 of housing 342 between first opening 348 and second opening 358 can provide for venting between the inner region of the ear canal and the ambient environment outside the ear canal.

A rear wall 353 is provided at a rear end of housing 342. Rear wall 353 is closed. An output transducer 305 is accommodated in a rear portion of inner space 345 of housing 342 in front of rear wall 353. A sound output 352 of output transducer 305 is provided at a front side of output transducer 305 opposing rear wall 353. Output transducer 305 is thus acoustically coupled to a front portion of inner space 345 surrounded by side wall 346. The front portion of inner space 345 constitutes a sound conduit through which sound can propagate from sound output 352 toward opening 358 at the front end of housing 342 along longitudinal axis 347. The venting channel provided between first opening 348 and second opening 358 extends through the sound conduit.

Earpiece 300 further comprises an acoustic valve 351. Acoustic valve 351 comprises a valve member 356 moveably coupled with housing 342. An inner side wall 184 of housing 342 extends through inner space 345 in a direction of longitudinal axis 347 in parallel to outer side wall 346. The moveable coupling of valve member 356 is provided along inner side wall 384. Valve member 356 can thus be moved relative to first opening 348 between different positions. A front portion 398 of valve member 356 radially extends between an outer surface of inner side wall 384 and an inner surface of outer side wall 346. Valve member 356 is moveable between a first position in which valve member 356 is positioned at a larger longitudinal distance from second opening 358, as illustrated in FIG. 3A, and a second position in which valve member 356 is positioned at a smaller longitudinal distance from second opening 358, as illustrated in FIG. 3B. In the first position of valve member 356, front portion 398 of valve member 356 is positioned behind first opening 348. In the second position of valve member 356, front portion 398 of valve member 356 is positioned in front of first opening 348. In the valve position depicted in FIG. 3A, venting channel 345 between first opening 348 and second opening 358 is open. In the valve position depicted in FIG. 3B, venting channel 345 between first opening 348 and second opening 358 is blocked by valve member 356, at least to some extent.

In this way, the effective size of venting channel 345 can be modified by the movement of valve member 356 relative to the venting channel. Other valve positions are conceivable in which the venting channel through opening 348 is blocked to a larger degree as in the situation illustrated in FIG. 3A and to a smaller degree as in the situation illustrated in FIG. 3B. Valve member 356 may thus be gradually moved relative to opening 348 in order to provide an increased or decreased effective size of opening 348. A first position and a second position of valve member 356 may correspond to any two of those positions. FIGS. 3A, 3B illustrate a translational movement of valve member 356 in the direction of longitudinal axis 347. Further conceivable is a rotational movement of valve member 356 around longitudinal axis 347 in order to increase or decrease the effective size of opening 348, or a combination of a translational and rotational movement.

Earpiece 300 further comprises an actuator 357. An active vent of earpiece 300 comprises acoustic valve 351 including valve member 356 and actuator 357, and venting channel 345 between first opening 348 and second opening 358. Actuator 357 is configured to provide an actuation force acting on valve member 356 for actuating the movement of valve member 356 between the different positions. For instance, a first actuation force may be provided to cause the movement of valve member 356 from the first valve position, as illustrated in FIG. 3A, to the second valve position, as illustrated in FIG. 3B. A second actuation force may be provided to cause the movement of valve member 356 from the second valve position, as illustrated in FIG. 3B, to the first valve position, as illustrated in FIG. 3A. The actuation force may be provided by an electric and/or magnetic interaction of actuator 357 with valve member 356. For instance, actuator 357 may be configured to provide a magnetic field acting on valve member 356 as the actuation force. For instance, actuator 357 may comprise a first magnetic member and valve member 356 may comprise a second magnetic member configured to interact with the first magnetic member via the magnetic field. To illustrate, actuator 357 may comprise a coil. Providing a current through the coil can produce a magnetic field depending on the provided current. A magnetic flux produced in the coil by the current can thus be changed by changing the current. Changing a polarity and/or an amount of the current through the coil can thus provide the actuation force to actuate the movement of valve member 356 in the different directions between the different valve positions. Earpiece 300 further comprises a connector 359. Via connector 359, processor 102 is operatively connectable to actuator 357. Processor 102 may also be operatively connected to output transducer 305 via connector 359.

The above description of earpiece 300 has been carried out for illustrative purposes without the intention to limit the scope of the subsequent disclosure in which operations related to an active vent included in a hearing device are described. An adjustment of an effective size of a venting channel by an acoustic valve may also be based on other interaction types of an actuator and a valve member which may include, for instance, actuation by an electrical field and/or transmission of a mechanical force and/or a pressure transfer and/or an actuation of a piezoelectric force. For example, the actuator may comprise a micromotor mechanically coupled to valve member in order to transmit a mechanical force from the micromotor to the valve member. As another example, the valve member may comprise a piezoelectric element and the actuator may comprise a conductor connected to the piezoelectric element such that a current through the conductor can produce a movement and/or deformation of the piezoelectric element. Some examples of an active vent which may be correspondingly applied to perform operations of a hearing device according to the present disclosure are described in patent application publication Nos. EP 2 164 277 A2 and DE 199 42 707 A1 in further detail.

Figure 4:
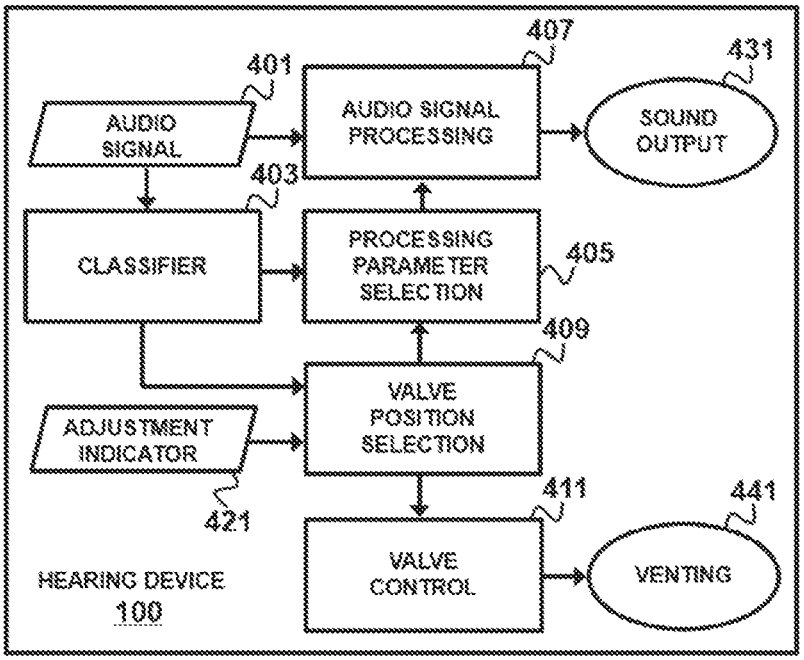
FIG. 4 schematically illustrates an exemplary configuration of a hearing device to process an audio signal depending on a classification of the audio signal and to control an actuator of an acoustic valve to adjust an effective size of a venting channel.

FIG. 4 illustrates a functional block diagram of an exemplary audio signal processing algorithm that may be executed by processor 102 of hearing device 100. As shown, the algorithm is configured to be applied to an audio signal 401 provided by sound detector 111. Audio signal 401 is input to processor 102. The algorithm comprises modules 403-411.

A classifier module 403 can determine a characteristic from audio signal 401 and classify audio signal 401 by assigning audio signal 401 to a class from a plurality of predetermined classes depending on the determined characteristic. The predetermined classes comprise at least two classes associated with different audio processing parameters which can be applied by processor 102 for a processing of audio signal 401. For instance, first audio processing parameters associated with a first class may be different from second audio processing parameters associated with a second class.

Classifier module 403 may comprise an audio signal analyzer module configured to analyze audio signal 401 to determine the characteristic of audio signal 401. For instance, the audio signal analyzer may be configured to identify at least one signal feature in audio signal 401, wherein the characteristic determined from audio signal 401 corresponds to a presence and/or absence of the signal feature. Exemplary characteristics include, but are not limited to, a mean-squared signal power, a standard deviation of a signal envelope, a mel-frequency cepstrum (MFC), a mel-frequency cepstrum coefficient (MFCC), a delta mel-frequency cepstrum coefficient (delta MFCC), a spectral centroid such as a power spectrum centroid, a standard deviation of the centroid, a spectral entropy such as a power spectrum entropy, a zero crossing rate (ZCR), a standard deviation of the ZCR, a broadband envelope correlation lag and/or peak, and a four-band envelope correlation lag and/or peak. For example, the audio signal analyzer may determine the characteristic from audio signal 401 using one or more algorithms that identify and/or use zero crossing rates, amplitude histograms, auto correlation functions, spectral analysis, amplitude modulation spectrums, spectral centroids, slopes, roll-offs, auto correlation functions, and/or the like. In some instances, the characteristic determined from audio signal 401 is characteristic of an ambient noise in an environment of the user, for instance a noise level, and/or a speech, for instance a speech level. The audio signal analyzer may be configured to divide audio signal 401 into a number of segments and to determine the characteristic from a particular segment, for instance by extracting at least one signal feature from the segment. The extracted feature may be processed to assign the audio signal to the corresponding class.

Classifier module 403 may comprise a classifier. The classifier can receive the characteristic determined by the audio signal analyzer from audio signal 401 and assign, depending on the determined characteristic, audio signal 401 to a class of at least two predetermined classes. The characteristic, for instance at least one signal feature, may be processed to assign the audio signal to the corresponding class. The classes may represent a specific content in the audio signal. Exemplary classes include, but are not limited to, low ambient noise, high ambient noise, traffic noise, music, machine noise, babble noise, public area noise, background noise, speech, nonspeech, speech in quiet, speech in babble, speech in noise, speech from the user, speech from a significant other, background speech, speech from multiple sources, and/or the like. In some instances, the classifier is configured to evaluate the characteristic relative to a threshold. The classes may comprise a first class assigned to the audio signal when the characteristic is determined to be above the threshold, and a second class assigned to the audio signal when the characteristic is determined to be below the threshold. For instance, when the characteristic determined from audio signal 401 is characteristic of an ambient noise, a first class representative of a high ambient noise may be assigned to the audio signal when the characteristic is above the threshold, and a second class representative of a low ambient noise may be assigned to the audio signal when the characteristic is below the threshold. As another example, when the characteristic determined from audio signal 401 is characteristic of a speech, a first class representative of a larger speech content may be assigned to the audio signal when the characteristic is above the threshold, and a second class representative of a smaller speech content may be assigned to the audio signal when the characteristic is below the threshold.

A processing parameter selection module 405 can select audio processing parameters from a plurality of mutually different audio processing parameters. The selected audio processing parameters can be applied by an audio signal processing module 407 for a processing of audio signal 401. The different audio processing parameters may be stored in memory 103 of hearing device 100 and the selected audio processing parameters may be accessed by processor 102 for the processing of audio signal 401. For instance, different sound processing programs specifying the audio processing parameters may be provided. Each of the sound processing programs may be stored in memory 103 of hearing device 100 and/or executable by processor 102. At least one sound processing program may specify audio processing parameters different from audio processing parameters specified by at least one other sound processing program. Processing parameter selection module 405 may comprise a sound processing program manager for selecting an appropriate sound processing program.

Processing parameter selection module 405 is configured to select the audio processing parameters based on the class assigned to audio signal 401 by classifier 403. To this end, each of the predetermined classes is associated with audio processing parameters that can be selected by audio signal processor 407. Processing parameter selection module 405 can then select the audio processing parameters associated with the class assigned to audio signal 401. At least two of the predetermined classes are associated with different audio processing parameters. The different audio processing parameters can thus be applied by audio signal processing module 407 for the processing of audio signal 401 depending on the class assigned to audio signal 401. The different audio processing parameters applied for the different classes may be optimized for different listening conditions associated with each class such that the different listening conditions can be accounted for by the audio processing parameters. In this way, a listening experience for the user can be improved when the listening conditions associated with the different classes change.

A sound output 431 can be provided according to audio signal 401 processed by audio signal processing module 407 based on the audio processing parameters selected by processing parameter selection module 405. Sound output 431 can be performed by output transducer 105. The processed audio signal may be amplified by a signal amplifier before outputting the sound by output transducer 105.

A valve control module 411 can control an actuation of a movement of a valve member of active vent 107 to adjust an effective size of venting channel 109. A venting 441 between an inner region of the ear canal and an ambient environment outside the ear canal through venting channel 109 can thus be adjusted by the movement of the valve member relative to venting channel 109. A valve position selection module 409 can select a target position for the valve member to which the valve member is moved from a current position by valve control module 411. For example, the valve member may be implemented by valve member 356 of the active vent illustrated in FIGS. 3A, 3B, wherein the current position of valve member 356 corresponds to one of the different positions illustrated in FIG. 3A or FIG. 3B and the target position of valve member 356 corresponds to the other of the different positions illustrated in FIG. 3A or FIG. 3B.

Valve position selection module 409 is configured to select the target position for the valve member based on the class assigned to audio signal 401 by classifier 403. To this end, valve position selection module 409 is configured to associate each of at least two classes with one of the different positions of the valve member and to select the position associated with the class assigned to audio signal 401. Valve control module 411 can then control a movement of the valve member to the position associated with the class assigned to audio signal 401. The different positions of the valve member applied for the different classes may be optimized for different listening conditions associated with each class such that the different listening conditions can be accounted for by the different valve positions. In this way, a listening experience for the user can be further improved when the listening conditions associated with the different classes change.

To illustrate, a more enlarged size of venting channel 109 may be suitable in some listening situations associated with at least one class of the predetermined classes to provide a better listening experience for the user. Those listening situations may include situations with a rather low ambient noise and/or situations in which the user speaks. The more enlarged size of venting channel 109 may be beneficial to allow direct sound in which ambient noise is predominantly absent to enter the inner region of the ear canal from the ambient environment through venting channel 109 and/or to mitigate the occlusion effect. Valve position selection module 409 may thus be configured to select the target position for the valve member such that the effective size of venting channel 109 is more enlarged when the class assigned to audio signal 401 by classifier 403 corresponds to a class representing a low ambient noise and/or an absence of specific noise sources such as traffic noise, machine noise, babble noise, public area noise and/or a speech of the user and/or a speech from a conversation partner and/or a speech in quiet. In this way, a more natural listening experience may be provided.

To further illustrate, a more reduced size of venting channel 109 may be suitable in listening situations associated with at least one other class of the predetermined classes to provide a better listening experience for the user. Those listening situations may include situations with a rather high ambient noise and/or situations in which the user has no intention to speak. The more reduced size of venting channel 109 may be beneficial to block direct sound comprising a rather large amount of ambient noise to directly enter the inner region of the ear canal from through the venting channel and/or to seal the user's hearing off from sounds produced in the ambient environment, for instance when the user has no intention to listen to ambient sound. For example, during streaming of an audio signal from a media source it may be assumed that the user has no interest to listen to direct sound from the ambient environment. Valve position selection module 409 may thus be configured to select the target position for the valve member such that the effective size of venting channel 109 is more reduced when the class assigned to audio signal 401 by classifier 403 corresponds to a class representing a high ambient noise and/or a presence of specific noise sources such as traffic noise, machine noise, babble noise, public area noise and/or an absence of a speech of the user and/or a speech from a conversation partner and/or a speech in noise. In this way, a more pleasant listening experience and/or better intelligibility of sound output 431 may be provided.

To further illustrate, a more reduced size of venting channel 109 may also be suitable for specific audio processing parameters selected by processing parameter selection module 405 associated with the class assigned by classifier module 403 to audio signal 401. Those audio processing parameters may include audio processing parameters providing for an acoustic beamforming, in particular beamforming with a high directivity, and/or audio processing parameters providing for noise cancellation in audio signal 401. The more reduced size of venting channel 109 may be beneficial to prevent bypassing of a desired effect of the audio processing parameters by direct sound entering the inner region of the ear canal from the ambient environment through venting channel 109. Valve position selection module 409 may thus be configured to select the target position for the valve member such that the effective size of venting channel 109 is more reduced when the class assigned to audio signal 401 by classifier 403 is associated with audio processing parameters providing for an effect that can be disturbed by a more enlarged size of venting channel 109.

Valve position selection module 409 is also configured to select the target position for the valve member based on an adjustment indicator 421 including instructions to adjust the effective size of venting channel 109. For instance, as described above, adjustment indicator 421 may be provided by user interface 113, 133 and/or based on sensor data provided by sensor 115, 135. The instructions provided by adjustment indicator 421 may overrule the selection of the target position for the valve member by valve position selection module 409 based on the class assigned to audio signal 401 by classifier 403. Valve position selection module 409 may thus select the target position for the valve member corresponding to the instructions provided by adjustment indicator 421 and ignore the target position for the valve member as determined based on the class assigned to audio signal 401.

To illustrate, in some hearing situations the user may prefer a different effective size of venting channel 109 as compared to the effective size selected by valve position selection module 409 based on the class assigned to audio signal 401. Such hearing situations may include situations in which the user is interested in directly listening to an ambient sound, wherein audio signal 401 representative of the ambient sound is assigned by classifier 403 to a class for which the venting channel 109 is selected by valve position selection module 409 to be more reduced as desired by the user. For instance, the user may attend an event at which sound of interest for the user is produced, which sound is assigned by classifier 403 to a class representing a rather high ambient noise and for which class the target position of the valve member selected by valve position selection module 409 corresponds to a more reduced size of the venting channel in order to block the sound from entering the inner region of the ear canal through venting channel 109. Examples for such an event may comprise a concert or a public speech attended by the user. The user may then adjust the effective size of the venting channel according to his preferences to an enlarged size via user interface 113, 133. User interface 113, 133 may then provide adjustment indicator 421 to valve position selection module 409 containing instructions for valve control module 411 to control the actuator of active vent 107 to move the valve member to a target position corresponding to an enlarged size of venting channel 109.

Furthermore, in some hearing situations the sensor data provided by sensor 115, 135 may indicate that a different effective size of venting channel 109 may be more appropriate than the effective size selected by valve position selection module 409 based on the class assigned to audio signal 401. Such sensor data may include physiological data indicating a certain physiological state of the user and/or environmental data indicating a certain property of the ambient environment of the user. For instance, the user may experience a health condition for which a more enlarged size of venting channel 109 may be more appropriate in order to allow an improved perception of the ambient environment by increased direct sound entering the inner region of the ear canal, e.g. when experiencing an anxiety disorder. During other health conditions, a more reduced size of venting channel 109 may be more appropriate, for instance to provide a better speech intelligibility when the user is talking to a support person such as a medical doctor. The health condition may be determined, for instance, by blood volume changes measured by a PPG sensor and/or temperature changes measured by a temperature sensor and/or electrical activities of the heart measured by an ECG sensor and/or electrical activities of the brain measured by an EEG sensor. As another example, the user may be interested in attending a certain speech source. Such an interest may also be determined by electrical activities of the brain measured by an EEG sensor. In such a situation, a more reduced size of venting channel 109 may be more appropriate in order to provide a better intelligibility of the speech source. As a further example, a barometric sensor may indicate pressure fluctuations in the ambient environment, e.g. during a flight. In such a situation, a more enlarged size of venting channel 109 may be more appropriate in order to allow a pressure equalization between the inner region of the ear canal and the ambient environment.

Processing parameter selection module 405 is configured to select the audio processing parameters depending on the position of the valve member selected by valve position selection module 409 for at least one of the predetermined classes. Different audio processing parameters may thus be selected by processing parameter selection module 405 when the valve member is at different positions and when at least one of the predetermined classes is equally assigned to audio signal 401 at the different positions of the valve member. In this way, sudden acoustical changes caused by a movement of the valve member between the different positions and a corresponding adjustment of the effective size of the venting channel can be compensated by the different audio processing parameters at the different positions of the valve member even if the respective class is equally assigned to audio signal at the different positions of the valve member.

To illustrate, reducing the effective size of the venting channel by a corresponding movement of the valve member under applying equal audio processing parameters may result in sound output 431 by output transducer 105 which may be perceived as too loud by the user. Moreover, a sudden change of the sound perception between the two positions of the valve member may be disturbing and uncomfortable for the user. Those effects can be mitigated or avoided by applying the different audio processing parameters at the different positions of the valve member. The different audio processing parameters at the different valve positions may be optimized for the respective class assigned to the audio signal 401 in conjunction with the respective position of the valve member. In particular, a sudden change of the acoustic configuration caused by the movement of the valve member may thus be compensated dynamically when the change is taking place. Tedious readjustments of the audio processing parameters by the user corresponding to the user's preferences may thus be avoided.

Figure 5:
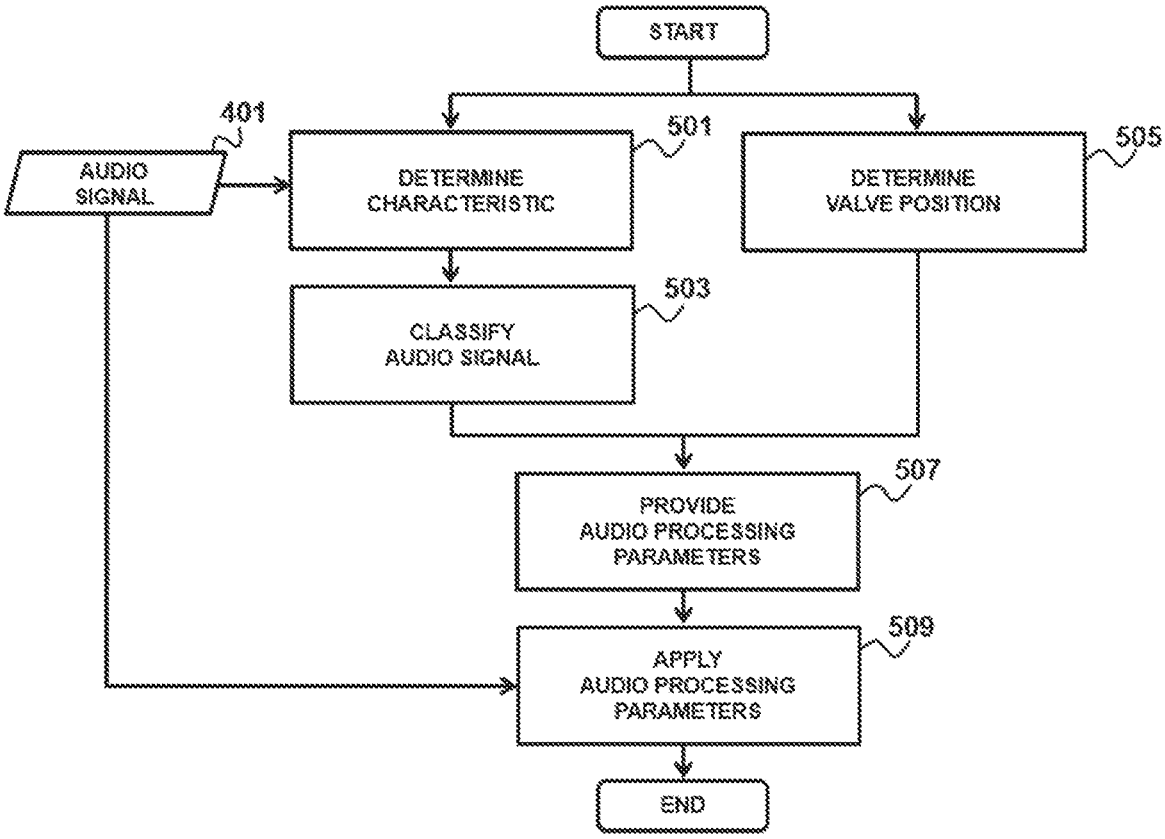
FIGS. 5-11 illustrate exemplary methods of operating a hearing device comprising an active vent.

FIG. 5 illustrates a block flow diagram for a method of operating a hearing device. The method may be executed by processor 102, in particular by executing the data processing algorithm illustrated in FIG. 4. At 501, a characteristic is determined from audio signal 401 representative of sound detected by sound detector 111. At 503, audio signal 401 is classified by assigning audio signal 401 to a class from a plurality of predetermined classes depending on the determined characteristic. Operations 501, 503 may be performed by classifier module 403. Concurrently, at 505, a position of the valve member of acoustic valve 108 of active vent 107 is determined. Determining the position of the valve member may comprise determining a current position at which the valve member is positioned at a present time. Determining the position of the valve member may also comprise determining a target position to which the valve member is intended to be moved. For instance, the target position may be determined from adjustment indicator 421. The target position may also be determined depending on the class assigned to audio signal 401 by classifier 403. In particular, a target position determined from adjustment indicator 421 may overrule a target position determined from the class assigned to audio signal 401. The different valve positions of effectuate a different effective size of venting channel 109. For instance, a first position of the valve member may produce a reduced size of venting channel 109 and a second position of the valve member may produce an enlarged size of venting channel 109. Operation 505 may be performed by valve position selection module 409.

At 507, audio processing parameters are provided depending on the class assigned to audio signal 401 at 503 and/or depending on the position of the valve member of acoustic valve 108 determined at 505. Different audio processing parameters may be applied when a different class is assigned to audio signal 401, and/or when the valve member is at different positions and when the class assigned to audio signal 401 is equal for at least one of the predetermined classes. The different positions of the valve member may be determined at 505, for instance when a target position deviates from a current position of the valve member. Different acoustic configurations caused by a movement of the valve member between the current position and the target position may thus be compensated by the different audio processing parameters at the different positions of the valve member. Operation 505 may be performed by processing parameter selection module 405. At 509, the audio processing parameters provided at 507 are applied for a processing of audio signal 401. Operation 509 may be performed by audio signal processing module 407.

Figure 6:
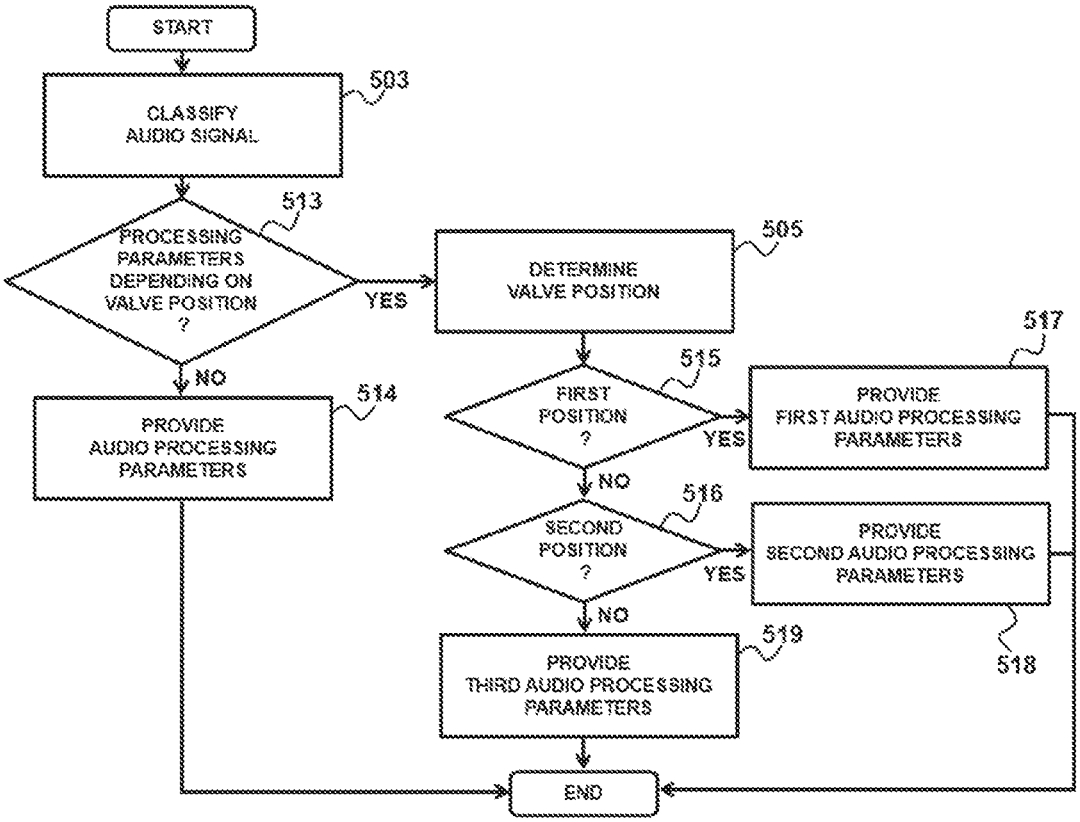

FIG. 6 illustrates another block flow diagram for a method of operating a hearing device. The method may be executed by processor 102, in particular by executing the data processing algorithm illustrated in FIG. 4. At 513, it is determined whether different audio processing parameters are applicable when the valve member is at different positions for the class assigned to audio signal 401 at 503. The class assigned to audio signal 401 may correspond to at least one class for which different audio processing parameters are provided when the valve member is at the different positions. The class assigned to audio signal 401 may also correspond to another class for which the same audio processing parameters are provided when the valve member is at the different positions. In the latter case, the same audio processing parameters are provided at 514 irrespective of the position of the valve member. In the first case, after determining the position of the valve member at 505, first audio processing parameters are provided at 517 when it is determined at 515 that the valve member is at a first position. Second audio processing parameters are provided at 518 when it is determined at 516 that the valve member is at a second position. If the valve member is neither at the first position nor at the second position, it may be concluded that the valve member is at a third position for which third audio processing parameters are provided at 519.

To illustrate, the first position of the valve member may correspond to any of the two positions of valve member 356 illustrated in FIG. 3A, FIG. 3B, the second position may correspond to the other position illustrated in FIG. 3A, FIG. 3B, and the third position may correspond to a position of valve member 356 in between the first position and the second position. The different audio processing parameters provided at 517, 518, 519 may be optimized to account for the varying acoustic configurations at the different positions of valve member 356 for the class assigned to audio signal 401 at 503. In some instances, different audio processing parameters are provided at different positions of the valve member for each class of the predetermined classes. Operations 513, 514 may then be omitted.

Figure 7:
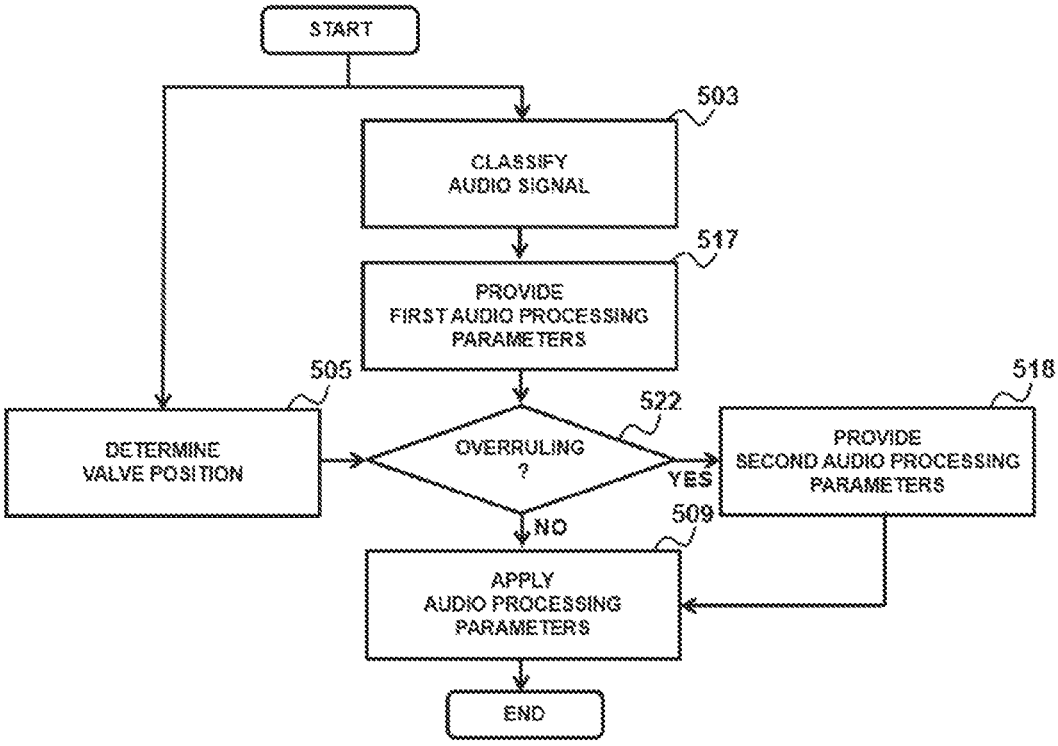

FIG. 7 illustrates another block flow diagram for a method of operating a hearing device. The method may be executed by processor 102, in particular by executing the data processing algorithm illustrated in FIG. 4. First audio processing parameters are provided at 517 depending on the class assigned to audio signal 401 at 503. The valve member may be positioned at a first position which may be selected based on the class assigned to audio signal 401 at 503. Determining the position of the valve member at 503, however, may indicate a second position of the valve member different from the first position to which the valve member shall be moved as a target position. In particular, adjustment indicator 421 may indicate a target position of the valve member to be different from a current position which has been selected based on the class assigned to audio signal 401.

At 522, it is determined whether the instructions to move the valve member from the first position to the second position overrule the instructions to leave the valve member positioned at the first position corresponding to the class assigned to audio signal 401. In a case in which the overruling is declined at 522, the valve member is kept at the first position. At 509, the first audio processing parameters corresponding to the first position of the valve member are applied for a processing of audio signal 401. In a case in which the overruling is accepted at 522, the valve member is moved from the first position to the second position. At the same time, second audio processing parameters are provided at 518. The second audio processing are adapted to compensate for a different acoustic sensation caused by the movement of the valve member, wherein the class assigned to audio signal 401 at 503 may be taken into account to provide for an optimized compensation. In this case, at 509, the second audio processing parameters corresponding to the second position of the valve member are applied for a processing of audio signal 401.

Figure 8:
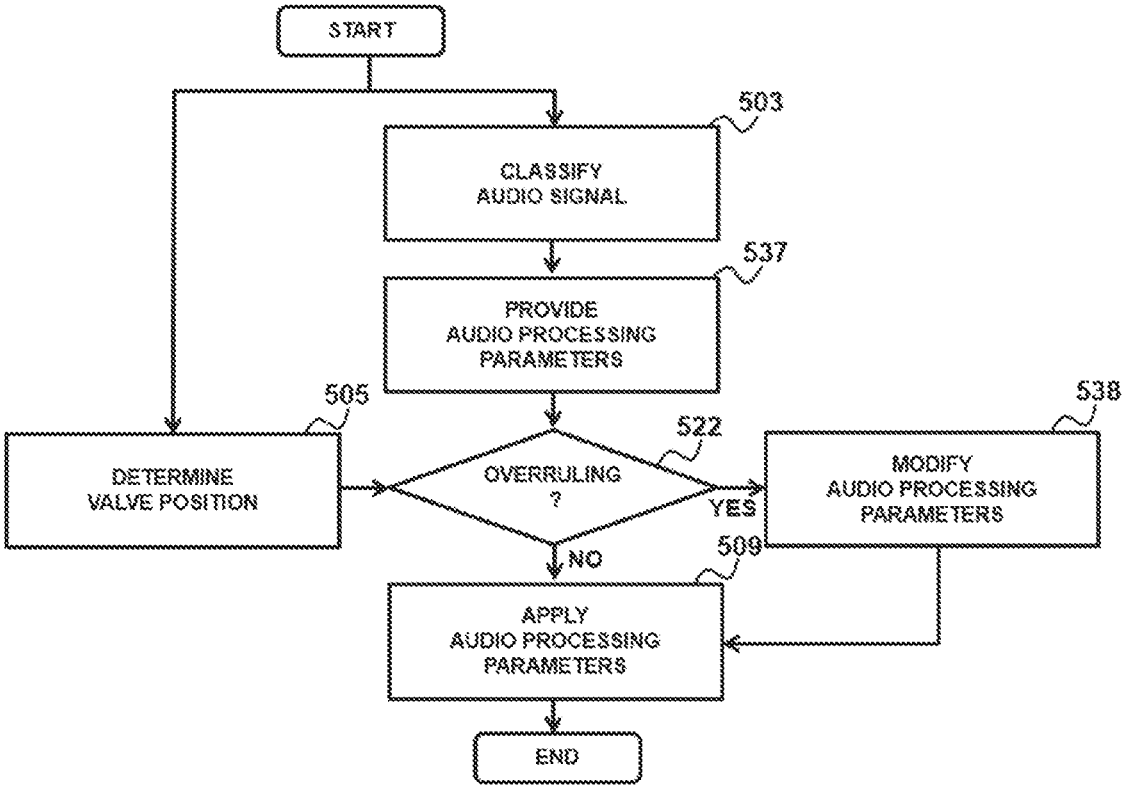

FIG. 8 illustrates another block flow diagram for a method of operating a hearing device. The method may be executed by processor 102, in particular by executing the data processing algorithm illustrated in FIG. 4. Audio processing parameters which are provided at 537 and a position of the valve member are selected based on the class assigned to audio signal 401 at 503. In a case in which overruling of the position of the valve member corresponding to the class assigned to audio signal 401 is accepted at 522, the valve member is moved from the current position to a target position. At the same time, the audio processing parameters provided at 517 are modified at 538. The modification can be based on predetermined modification rules. The modification rules may comprise combining the audio processing parameters provided at 517 with modification parameters. For instance, the modification parameters may comprise audio processing parameters which are added or subtracted from the audio processing parameters provided at 517. The modified audio processing parameters are then applied at 509 for a processing of audio signal 401.

Figure 9:
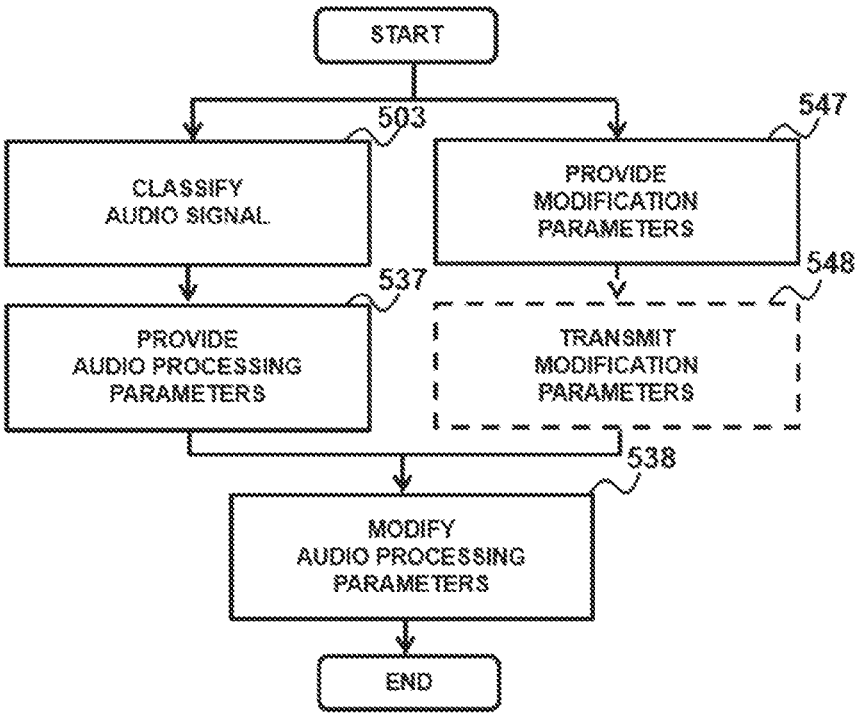

FIG. 9 illustrates a block flow diagram for a method of modifying audio processing parameters based on a class assigned to audio signal 401. The method may be executed by the hearing system illustrated in FIG. 1, in particular by processor 102 of hearing device 100 and/or by processor 122 of remote device 120. At 547, modification parameters are provided. Modification parameters are provided at 547 which are adapted to be combined with the audio processing parameters provided at 537 based on a class assigned to audio signal 401 at 503. The modification parameters may be stored in memory 103 of hearing device 100 and/or in memory 123 of remote device 120. The modification parameters may be retrieved from the memory by processor 102 of hearing device 100 and/or by processor 122 of remote device 120. The modification parameters may also be obtained by processor 102 of hearing device 100 and/or by processor 122 of remote device 120 from computer implemented medium 131, for instance an external data storage provided by cloud 130. For example, remote device 120 may be a mobile device, such as a smartphone, or a stationary device, such as a PC, equipped with an application (app) to communicate with cloud 130 via communication port 124. Data 132 downloaded from computer implemented medium 131 may then comprise the modification parameters. After obtaining the modification parameters from computer implemented medium 131, processor 102 of hearing device 100 and/or processor 122 of remote device 120 may store the modification parameters in memory 103, 123 such that they can be retrieved in operation 547 at a later time. In a case in which the modification parameters are provided by processor 122 of remote device 120, the modification parameters are transmitted to processor 102 of hearing device 100 via communication ports 104, 124 at 548.

At 538, the audio processing parameters provided at 537 are modified by the modification parameters provided at 547. The audio processing parameters provided at 517 may be combined with the modification parameters, for instance, by adding or subtracting. To illustrate, the modification parameters may specify audio amplification schemes which may be combined with audio amplification schemes of the audio processing parameters provided at 537. It may be that the audio amplification schemes are added or subtracted. For instance, the modification parameters may comprise amplification levels and/or frequency dependent gain curves that can be added to or subtracted from amplification levels and/or frequency dependent gain curves specified by the audio processing parameters provided at 537.

Modifying the audio processing parameters provided at 537 based on a class assigned to audio signal 401 at 503 can be implemented to provide different audio processing parameters for different positions of the valve member of active vent 107 when the same class is assigned to audio signal 401. The modified audio processing parameters may be provided in operation 538 and/or in any of operations 507, 517, 518, 519. The audio processing parameters provided at 537 may correspond to audio processing parameters provided at a position of the valve member which is selected by valve position selection module 409 based on the class assigned to audio signal 401 by classifier 403, and the modified audio processing parameters provided at 507, 517, 518, 519, 538 may correspond to audio processing parameters which are provided at a different position of the valve member when the same is class assigned to audio signal 401 by classifier 403. In this way, different acoustic configurations at the different positions of the valve member can be compensated by the audio processing parameters provided at 537 applied at a specific position of the valve member, and by the modified audio processing parameters applied at a different position. Modifying the audio processing parameters provided at 537 in such a manner can further allow to reduce a number of the different audio processing parameters stored in memory 103 of hearing device 100. To illustrate, different audio processing parameters associated with different classes may be stored in memory 103 which then may be modified when the position of the valve member is different from a position associated with the class of the audio processing parameters stored in memory 103. Thus, a storage space required for storing the different audio processing parameters in memory 103 may be reduced, wherein a compensation of the different acoustic configurations at the different positions of the valve member can still be accounted for.

Figure 10:
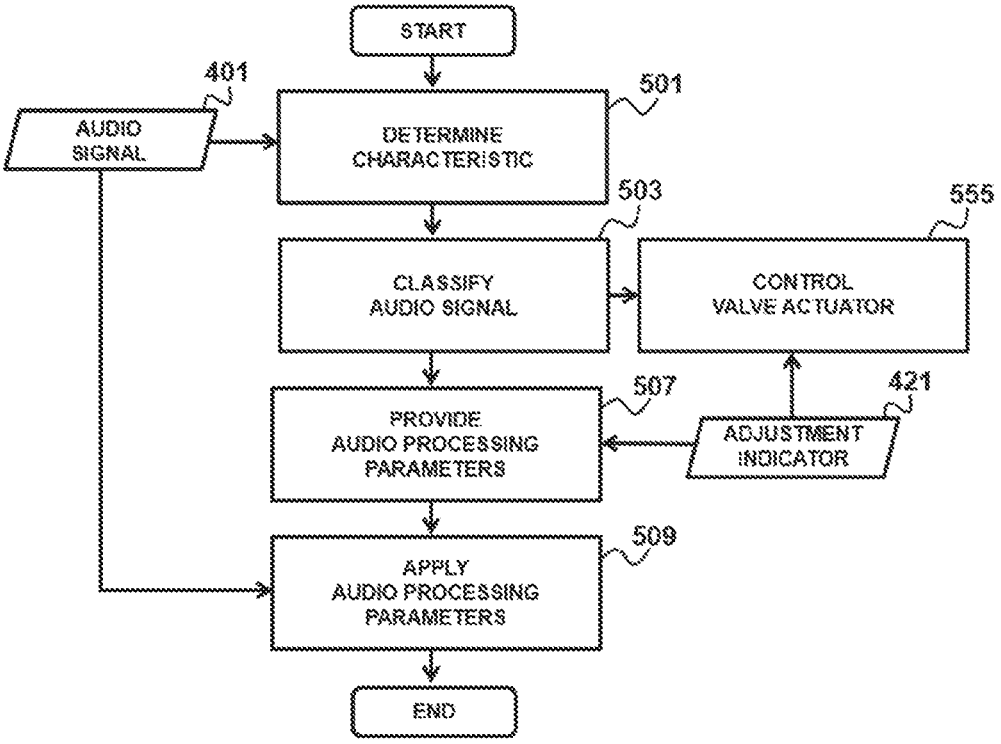

FIG. 10 illustrates a block flow diagram for a method of operating a hearing device. The method may be executed by processor 102, in particular by executing the data processing algorithm illustrated in FIG. 4. At 555, the actuator of acoustic valve 108 is controlled to move the valve member to the position associated with the class assigned to audio signal 401 in operation 503 and/or to the position according to the instructions of adjustment indicator 421. Operation 555 may be performed by valve control module 411. When the instructions of adjustment indicator 421 deviate from the position associated with the class assigned to audio signal 401, the instructions of adjustment indicator 421 may overrule the controlling of the position of the valve member based on the class assigned to audio signal 401, for instance by performing operation 522 in the method illustrated in FIGS. 7 and 8.

Audio processing parameters provided at 507 may be selected corresponding to the class assigned to audio signal 401 in operation 503 and/or corresponding to the position according to the instructions of adjustment indicator 421. At least for one of the predetermined classes assigned to audio signal 401 in operation 503, different audio processing parameters may be provided when the valve member is at the different positions and the class assigned to the audio signal equally corresponds to this class. Operation 507 may be performed by processing parameter selection module 405. In particular, when the instructions of adjustment indicator 421 deviate from the position associated with the class assigned to audio signal 401, the audio processing parameters selected corresponding to the class assigned to audio signal 401 in operation 503 may be overwritten by different audio processing parameters. The different audio processing parameters can account for the different acoustic configuration when the valve member is moved to the position according to the instructions of adjustment indicator 421.

Figure 11:
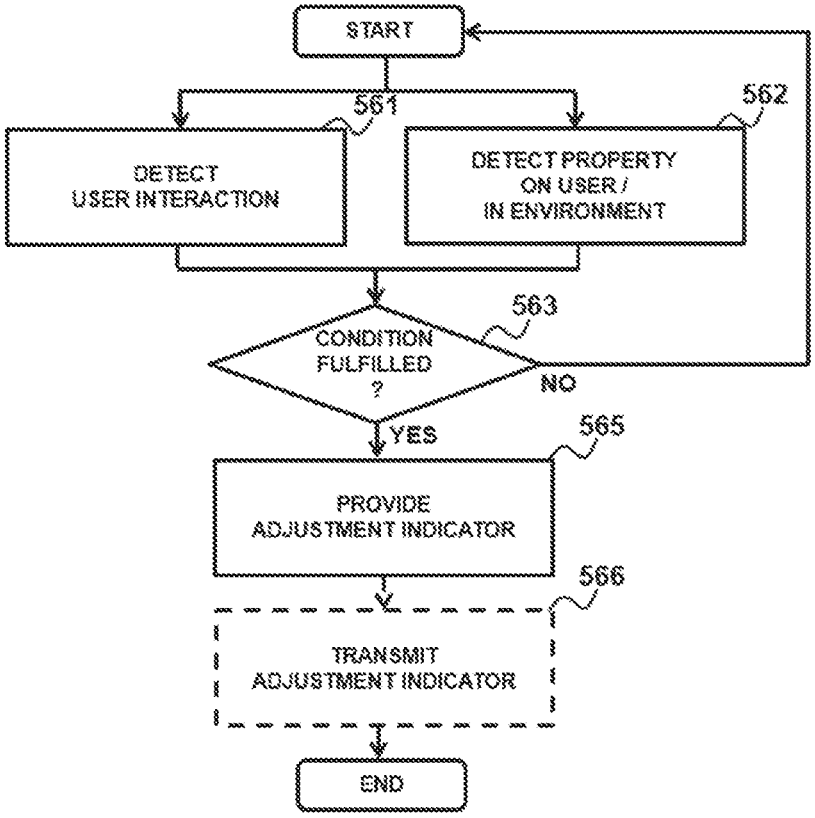

FIG. 11 illustrates a block flow diagram for providing an adjustment indicator providing instructions to move the valve member of acoustic valve 108 from a current position to a target position. The method may be executed by the hearing system illustrated in FIG. 1, in particular by processor 102 of hearing device 100 and/or by processor 122 of remote device 120. At 561, a user interaction is detected. Detecting the user interaction may be based on user input data provided by user interface 113 of hearing device device 100 and/or by user interface 133 of remote device 120.

Alternatively or additionally, at 562, a property is detected on the user and/or in the ambient environment of that user. Detecting the property may be based on sensor data provided by sensor 115 of hearing device 100 and/or sensor 135 of remote device 120. At 563, it is determined whether the user interaction and/or the property detected on the user and/or in the environment fulfills a condition. The condition may be that the user interaction is indicative of a command by the user to move the valve member to a different position in order to change the effective size of venting channel 109. The condition may also be that the sensor data indicates that a different position of the valve member is more appropriate than the position selected based on the class assigned to audio signal 401. In a case in which the condition is fulfilled, an adjustment indicator is provided at 565. The adjustment indicator comprises instructions for processor 102 to control a movement of the valve member to the different position as indicated by the user interaction and/or the property detected on the user and/or in the environment fulfilling the condition at 563. The adjustment indicator may be provided by processor 102 of hearing device 100 and/or by processor 122 of remote device 120. In a case in which the adjustment indicator is provided by processor 122 of remote device 120, the adjustment indicator is transmitted at 566 to processor 102 of hearing device 100 via communication ports 104, 122.

Figure 12A:
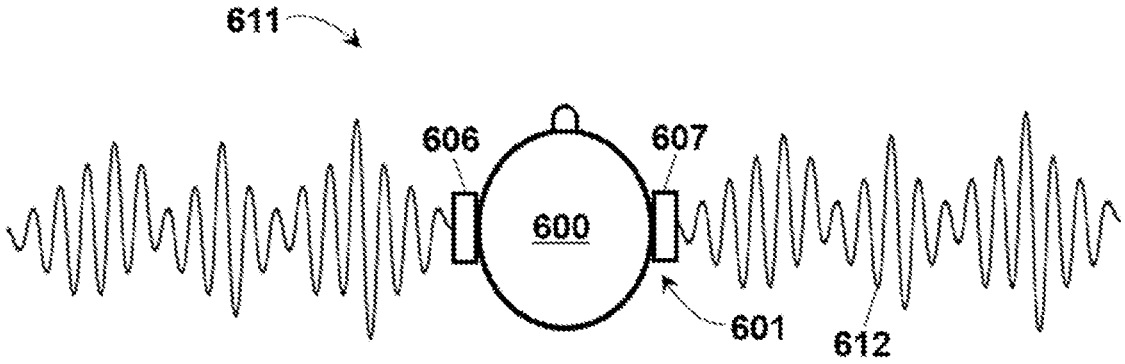
FIGS. 12A, B schematically illustrate exemplary hearing situations involving different characteristics of ambient noise.
Figure 12B:
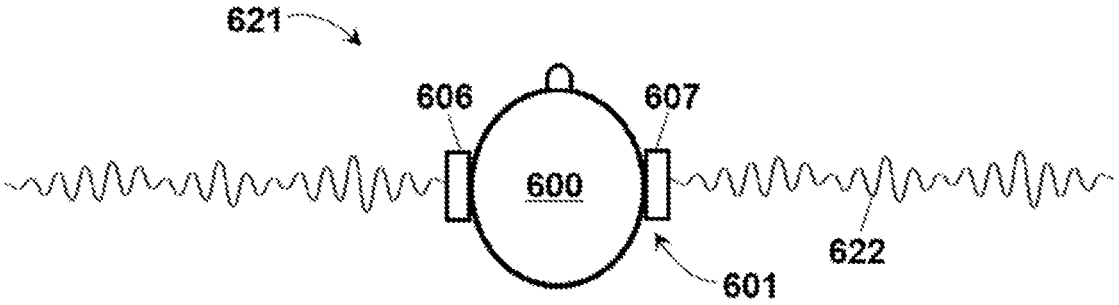

FIGS. 12A, 12B schematically illustrate different hearing situations 611, 621 experienced by a user 600 wearing a binaural hearing system 601 comprising two hearing devices 606, 607 worn at a left ear and a right ear of user 600. Each of hearing devices 606, 607 may be implemented corresponding to hearing device 100 and/or hearing device 200 described above. In the hearing situation 611 illustrated in FIG. 12A, user 600 is exposed to a high noise level 612 of the sound detected by sound detector 111 of hearing devices 606, 607 in the ambient environment. In such a hearing situation, a reduced size of venting channel 109 can be often advantageous to block the ambient noise 612 from directly entering the inner region of the ear canal via venting channel 109. Audio processing parameters associated with a class representative of the high level of ambient noise 612 which are assigned to audio signal 401 can thus be more effective. For instance, audio processing parameters optimized for a noise reduction could be negatively affected by ambient noise 612 entering through venting channel 109. Correspondingly, the valve member may be controlled by processor 102 to move the valve member to a position providing for the reduced size of venting channel 109 when the class representative of the high level of ambient noise 612 is assigned to audio signal 401.

Yet in some instances of hearing situation 611, user 600 may prefer a more enlarged effective size of venting channel 109, for instance when user 600 is interested in a content of the ambient sound for which the detected audio signal has been classified into the class representative of the high noise level. To illustrate, during a concert the user may prefer the more enlarged effective size of venting channel 109 to experience the sound in a more natural way. User 600 may then adjust the effective size of venting channel 109 according to his preferences via user interface 113, 133. Suddenly moving the valve member to the different position to provide for the enlarged effective size of venting channel 109, however, can lead to a disturbing hearing experience for the user when the audio processing parameters applied for a processing of audio signal 401 would still be optimized for the acoustic configuration in which venting channel 109 has the more reduced size. Such a disturbing effect can be avoided by applying different audio processing parameters when the valve member is at the different position which account for the altered acoustic configuration caused by the enlarged effective size of venting channel 109.

In the hearing situation 621 illustrated in FIG. 12B, user 600 is exposed to a low noise level 622 of the detected sound. An enlarged size of venting channel 109 can here be preferable allowing the low ambient noise 622 to directly enter the inner region of the ear canal which can provide for a more natural sound experience and/or mitigate occlusion. The valve member may thus be controlled by processor 102 to move the valve member to a position providing for an enlarged size of venting channel 109 when a class representative of the low level of ambient noise 622 is assigned to audio signal 401. User 600 may nevertheless prefer a more reduced effective size of venting channel 109 in some instances of hearing situation 621, for instance when the user wants to purely focus on the sound output generated by output transducer 105. Reducing the effective size of venting channel 109 via user interface 113, 133 can again lead to a disturbing hearing experience when the audio processing parameters optimized for the more enlarged size of venting channel 109 would be applied. For instance, the sound output generated by output transducer 105 according to the audio processing parameters optimized for the more enlarged size of venting channel 109 can be perceived as too loud when suddenly reducing the effective size of venting channel 109. To avoid this effect, different audio processing parameters may be applied when the valve member is at the different position corresponding to the reduced effective size of venting channel 109.

Figure 13A:
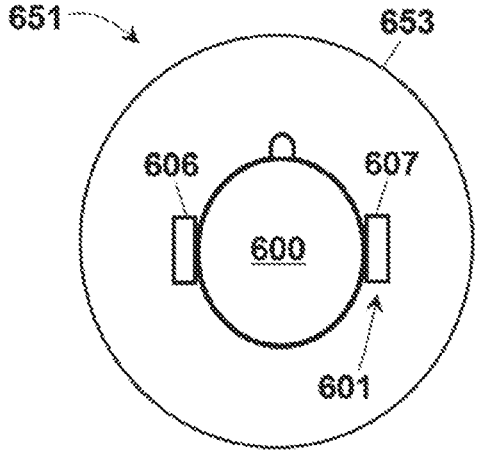
FIGS. 13A, B schematically illustrate exemplary effects of different audio processing parameters applied to an audio signal.
Figure 13B:
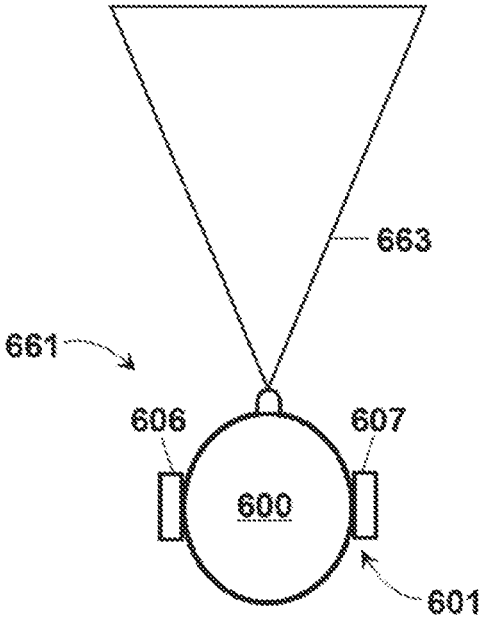

FIGS. 13A, 13B schematically illustrate different hearing effects 651, 661 produced by different audio processing parameters applied to audio signal 401. The audio processing parameters producing hearing effect 651 illustrated in FIG. 13A are adapted to provide for an omnidirectional audio content 653 in the processed audio signal reproduced by output transducer 105. The term "omnidirectional audio content", as used herein, indicates that substantially no directivity, in particular no acoustic beam forming, is provided during the processing of audio signal 401 by applying the audio processing parameters. Those audio processing parameters may be often appropriate for a class assigned to audio signal 401 during low ambient noise 622, as illustrated in FIG. 12B. The audio processing parameters may then be associated with a position of the valve member accounting for an enlarged effective size of venting channel 109. The audio processing parameters producing hearing effect 661 illustrated in FIG. 13B are adapted to provide for a directivity of the audio content in the processed audio signal forming an acoustic beam 663 reproduced by output transducer 105. Those audio processing parameters may be often appropriate for a class assigned to audio signal 401 during high ambient noise 612, as illustrated in FIG. 12A. The audio processing parameters may then be associated with a position of the valve member accounting for a reduced effective size of venting channel 109.

When adjusting the effective size of venting channel 109 to a different size by moving the valve member to a position different from the position associated with the class assigned to audio signal 401, the audio processing parameters producing hearing effects 651, 661 may not be appropriate for the different acoustic configuration. For instance, when user 600 adjusts venting channel 109 to an enlarged size, a directivity of acoustic beam 663 may not be desirable to the same extent since it may indicate an interest of the user to perceive ambient sound 612 including noise. Accordingly, the different audio processing parameters at the different position of the valve member when venting channel 109 is enlarged may account for a widening of acoustic beam 663 and/or a change of a direction of acoustic beam 663 from which the ambient sound may be predominantly detectable.

Conversely, when user 600 adjusts venting channel 109 to a reduced size, omnidirectional audio content 653 may be undesired since it may indicate an intention of the user to block ambient sound 612 from directly entering through venting channel 109, for instance to be able to focus on a specific audio content reproduced by output transducer 105. Accordingly, the different audio processing parameters at the different positions of the valve member when venting channel 109 is reduced may account for suppressing an ambient audio content in audio signal 401, for instance when the user is listening to an alternative sound source. For instance, ambient audio content may be suppressed when streaming from a remote audio source and when venting channel 109 is reduced. Streaming from the remote audio source may be performed via communication port 104. Processor 102 may determine the presence of a streaming from the remote audio source, in particular as a condition to be fulfilled in operation 563 for providing the adjustment indicator in operation 565. The different audio processing parameters may also provide for a directivity of audio content in the processed audio signal 401, for instance when the user is listening to a specific sound source in his environment such as a conversation partner. Processor 102 may determine an own voice activity of the user as an indication for a conversation situation, in particular as a condition to be fulfilled in operation 563 for providing the adjustment indicator in operation 565.

Figure 14:
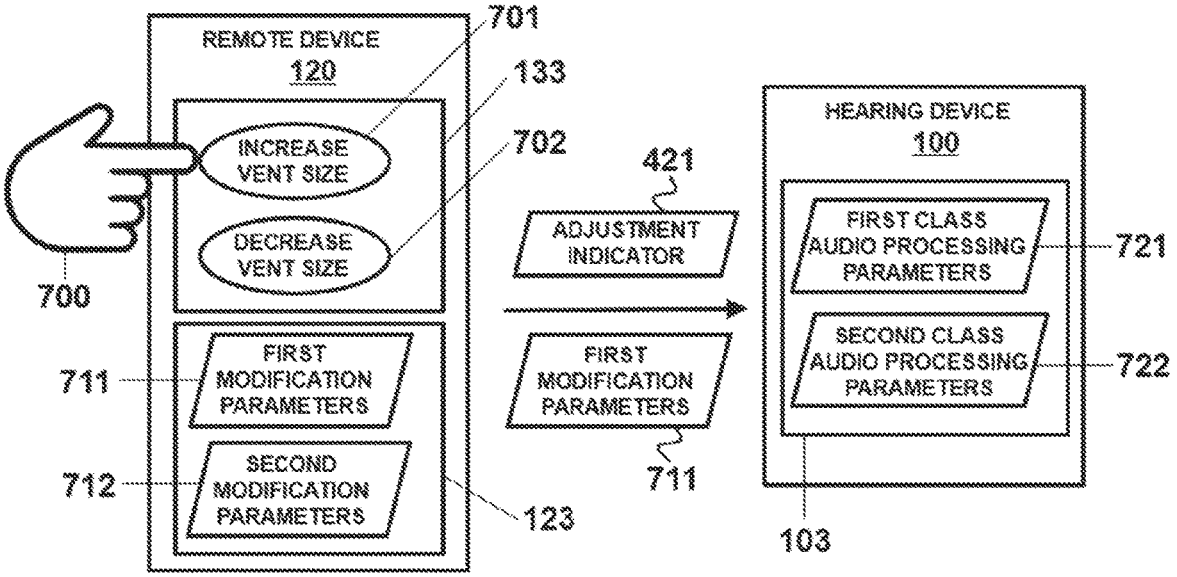
FIGS. 14, 15 schematically illustrate exemplary configurations of a hearing system comprising a hearing device and a remote device employed for controlling an actuator of an acoustic valve to adjust an effective size of a venting channel in the hearing device.

FIG. 14 schematically illustrates a hearing system comprising hearing device 100 and remote device 120 during an operation in which adjustment indicator 421 including instructions to adjust the effective size of venting channel 109 is transmitted from remote device 120 to hearing device 100. User interface 133 of remote device 120 comprises an input option 701 for enlarging the effective size of venting channel 109, and an input option 702 for reducing the effective size of venting channel 109. For instance, input options 701, 702 may be implemented as a push button, control dial, touch surface, voice command operation, and/or the like. For instance, as illustrated, user 600 may use his hand 700 to initiate enlarging the effective size of venting channel 109 via input option 701. Adjustment indicator 421 transmitted from remote device 120 to hearing device 100 then includes instructions to move the valve member to a different position at which the effective size of venting channel 109 is enlarged. Conversely, adjustment indicator 421 includes instructions to move the valve member to a position at which the effective size of venting channel 109 is reduced when reducing the effective size of venting channel 109 is selected via input option 702.

Memory 123 of remote device 120 stores first modification parameters 711 associated with input option 701 for enlarging the effective size of venting channel 109, and second modification parameters 712 associated with input option 702 for reducing the effective size of venting channel 109. When input option 701 is selected, first modification parameters 711 are transmitted from hearing device 100 to remote device 120. When input option 702 is selected, second modification parameters 712 are transmitted from hearing device 100 to remote device 120. Memory 103 of hearing device 100 stores a plurality of different audio processing parameters 721, 722 associated with different classes that can be assigned to audio signal 401. First audio processing parameters 721 are selected when audio signal 401 is assigned to a first class. Second audio processing parameters 722 are selected when audio signal 401 is assigned to a second class. After selecting, audio processing parameters 721, 722 are modified by the modification parameters 711, 712 which have been transmitted from remote device 120 to hearing device 100. The modified audio processing parameters are then applied for a processing of audio signal 401.

In some other implementations, modification parameters 711, 712 are stored in memory 103 of hearing device 100 and selected depending on the instructions of adjustment indicator 421 to enlarge or reduce the effective size of venting channel 109. Adjustment indicator 421 may be transmitted from remote device 120 to hearing device 100. Adjustment indicator 421 may also be provided by user interface 113 of hearing device 100 and/or by processor 102 of hearing device 100 depending on sensor data provided by sensor 115, 135.

Figure 15:
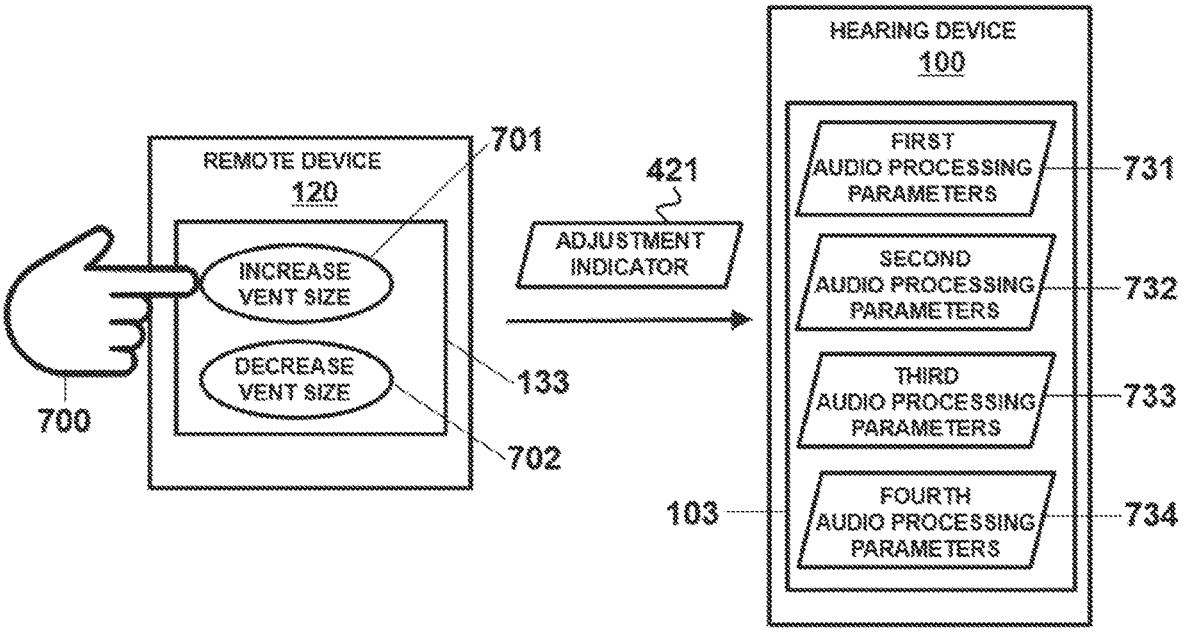

FIG. 15 schematically illustrates a hearing system comprising hearing device 100 and remote device 120 during an operation in which adjustment indicator 421 including instructions to adjust the effective size of venting channel 109 is transmitted from remote device 120 to hearing device 100. Memory 103 of hearing device 100 stores a plurality of different audio processing parameters 731-734 associated with different classes that can be assigned to audio signal 401 and associated with different position of the valve member of acoustic valve 108 for at least one of the different classes. In the illustrated example, memory 103 stores first audio processing parameters 731 and second audio processing parameters 732 which may be associated with different positions of the valve member when a first class is attributed to audio signal 401. Memory 103 further stores third audio processing parameters 733 and fourth audio processing parameters 734 which may be associated with different positions of the valve member when a second class is attributed to audio signal 401. When the first class is assigned to audio signal 401, either first or second audio processing parameters 731, 732 can be applied for a processing of audio signal 401 depending on a momentary position of the valve member and/or the instructions of adjustment indicator 421 to move the valve member to a different position. When the second class is assigned to audio signal 401, either third or fourth audio processing parameters 733, 734 can be applied for a processing of audio signal 401 depending on the momentary position of the valve member and/or the instructions of adjustment indicator 421 to move the valve member to a different position.

While the principles of the disclosure have been described above in connection with specific devices and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

What is claimed is:

1. A hearing device comprising:

a housing configured to be at least partially inserted into an ear canal of a user and comprising a venting channel, wherein the venting channel is configured to provide for venting between an inner region of the ear canal and an ambient environment outside the ear canal through the venting channel;

an acoustic valve comprising a valve member moveable relative to the venting channel between different positions, wherein an effective size of the venting channel is adjustable by a movement of the valve member between the different positions, and an actuator configured to actuate the movement of the valve member;

a sound detector configured to provide an audio signal representative of a detected sound;

a processor configured to determine a characteristic from the audio signal and to classify the audio signal by assigning the audio signal to a class from a plurality of predetermined classes depending on the determined characteristic, at least two classes included in the plurality of predetermined classes associated with different audio processing parameters applied by the processor for a processing of the audio signal; and an output transducer configured to be acoustically coupled to the inner region of the ear canal and to generate a sound output according to the audio signal processed by the processor;

wherein:

the processor is configured to apply different audio processing parameters when the valve member is at the different positions, wherein the class assigned to the audio signal is the same for at least one of the plurality of predetermined classes at the different positions of the valve member; and the plurality of predetermined classes comprises a first class for which the associated audio processing parameters comprise audio processing parameters providing for a directivity of audio content in the processed audio signal, and a second class for which the associated audio processing parameters comprise audio processing parameters providing for an omnidirectional audio content in the processed audio signal.

2. The hearing device of claim 1, wherein the processor is configured to apply different audio processing parameters at the different positions of the valve member for each of at least two of the plurality of predetermined classes that are assigned to the audio signal when the valve member is at the different positions.

3. The hearing device of claim 1, wherein:

the processor is configured to apply the different audio processing parameters when the first class is assigned to the audio signal at the different positions of the valve member; and the different audio processing parameters comprise audio processing parameters providing for an increased directivity of the audio content in the processed audio signal and audio processing parameters providing for a decreased directivity of the audio content in the processed audio signal.

4. The hearing device of claim 1, further comprising a memory storing the different audio processing parameters applied by the processor when the valve member is at the different positions and the class assigned to the audio signal is the same at the different positions of the valve member.

5. The hearing device of claim 1, wherein the characteristic determined from the audio signal comprises a characteristic of an ambient noise.

6. The hearing device of claim 1, wherein the processor is configured to associate each of at least two of the predetermined classes with one of the different positions of the valve member and to control the actuator to move the valve member to the position associated with the class assigned to the audio signal.

7. The hearing device of claim 6, wherein the processor is configured to control the actuator to move the valve member from the position associated with the class assigned to the audio signal to a target position according to instructions from a user interface.

8. The hearing device of claim 1, wherein the processor is configured to receive instructions from a user interface to control the actuator to move the valve member between the different positions from a current position to a target position.

9. The hearing device of claim 1, wherein the processor is configured to determine at least one of the different audio processing parameters applied at the different positions of the valve member when the class assigned to the audio signal is the same by modifying the audio processing parameters associated with the class assigned to the audio signal based on predetermined modification rules.

10. The hearing device of claim 9, wherein the predetermined modification rules comprise predetermined audio processing parameters which are combined with the audio processing parameters associated with the class assigned to the audio signal.

11. The hearing device of claim 9, wherein the processor is configured to receive the predetermined modification rules from a remote device.

12. A hearing system comprising the hearing device of claim 9 and a remote device comprising an additional processor configured to provide the predetermined modification rules to the hearing device.

13. A method of operating a hearing device, the hearing device comprising:

a housing configured to be at least partially inserted into an ear canal of a user and comprising a venting channel, wherein the venting channel is configured to provide for venting between an inner region of the ear canal and an ambient environment outside the ear canal through the venting channel;

an acoustic valve comprising a valve member moveable relative to the venting channel between different positions, wherein an effective size of the venting channel is adjustable by a movement of the valve member between the different positions, and an actuator configured to actuate the movement of the valve member;

a sound detector configured to provide an audio signal representative of a detected sound; and an output transducer configured to be acoustically coupled to the inner region of the ear canal and to generate a sound output according to the audio signal after a processing of the audio signal, the method comprising:

determining a characteristic from the audio signal;

classifying the audio signal by assigning the audio signal to a class from a plurality of predetermined classes depending on the determined characteristic, at least two classes included in the plurality of predetermined classes associated with different audio processing parameters applied for the processing of the audio signal; and applying different audio processing parameters when the valve member is at the different positions, wherein the class assigned to the audio signal is the same for at least one of the plurality of predetermined classes at the different positions of the valve member, wherein the plurality of predetermined classes comprises a first class for which the associated audio processing parameters comprise audio processing parameters providing for a directivity of audio content in the processed audio signal, and a second class for which the associated audio processing parameters comprise audio processing parameters providing for an omnidirectional audio content in the processed audio signal.

14. The method of claim 13, further comprising applying different audio processing parameters at the different positions of the valve member for each of at least two of the plurality of predetermined classes assigned to the audio signal when the valve member is at the different positions.

15. The method of claim 13, further comprising applying the different audio processing parameters when the first class is assigned to the audio signal at the different positions of the valve member, wherein the different audio processing parameters comprise audio processing parameters providing for an increased directivity of the audio content in the processed audio signal and audio processing parameters providing for a decreased directivity of the audio content in the processed audio signal.

16. The method of claim 13, further comprising storing the different audio processing parameters applied when the valve member is at the different positions and the class assigned to the audio signal is the same at the different positions of the valve member.

17. The method of claim 13, wherein the characteristic determined from the audio signal comprises a characteristic of an ambient noise.

* * * * *